US009837054B1

(12) United States Patent
McCabe

(10) Patent No.: US 9,837,054 B1
(45) Date of Patent: Dec. 5, 2017

(54) HEADPIECE AND MAGNETIC TUNERS

(71) Applicant: Geoffrey Lee McCabe, Hollywood, CA (US)

(72) Inventor: Geoffrey Lee McCabe, Hollywood, CA (US)

( * ) Notice: Subject to any disclaimer, the term of this patent is extended or adjusted under 35 U.S.C. 154(b) by 0 days.

(21) Appl. No.: 15/493,123

(22) Filed: Apr. 20, 2017

(51) Int. Cl.

| | |
|---|---|
| ***G10D 3/04*** | (2006.01) |
| ***G10D 3/14*** | (2006.01) |
| ***G10D 1/08*** | (2006.01) |
| ***G10D 3/12*** | (2006.01) |

(52) U.S. Cl.
CPC ..... *G10D 3/146* (2013.01); *G10D 1/085* (2013.01); *G10D 3/04* (2013.01); *G10D 3/12* (2013.01); *G10D 3/14* (2013.01)

(58) Field of Classification Search
CPC ..... G10D 3/146; G10D 1/085; G10D 3/04; G10D 3/12; G10D 3/14
See application file for complete search history.

(56) References Cited

U.S. PATENT DOCUMENTS

2014/0260890 A1* 9/2014 Artino ..... G10D 3/14 84/297 R

* cited by examiner

*Primary Examiner* — Kimberly Lockett

(57) ABSTRACT

HEADPIECE TUNER is integrated into the nut arrangement of a traditional headless musical instrument featuring lever-based individual string clamps, a removable nut, a truss rod adjustment feature and multi-function cross bar handle. A Magnetic Tuner comprising at least one of two magnetic elements secured to a tremolo, in fulcrum tremolos, moveable therewith about the tremolo pivot axis, in a mechanism operable to provide a first force of tension comprising the traditional tremolo coil spring biasing element and/or, in the case of coil spring integrated tremolo stabilizers, provide a second force of tension to enforce the tremolo at the equilibrium point or initial position.

21 Claims, 10 Drawing Sheets

10
12
14
16
17
6
18
15
13
50
3
27
21
51
25
54
53
19
28

HEADPIECE AND MAGNETIC TUNERS

I, Geoffrey McCabe, claim, a Continuation In Part for HEADPIECE AND MAGNETIC TUNERS, based on the parent application, McCabe U.S. application Ser. No. 14/945,035, Nov. 18, 2015, issued as U.S. Pat. No. 9,484,007, Nov. 1, 2016, for Species III election entitled TREMOLO STOP TUNER AND TREMOLO STABILIZER [and its Divisional application Ser. No. 15/296,401, Oct. 18, 2016 entitled, TREMOLO SPRING AND STABILIZER TUNERS comprising Species I, II and IV].

The parent application presents improvements providing a variable resilient element, capable of holding a variable pre-load, to meet the two primary variable force of tension requirements in a floating tremolo setup for either: 1) apparatuses for establishing initial position or 2) enforcing its initial position and comprising two variable forces of tension, where a) one force of tension is greater than the second force of tension and b) the second variable force of tension created by the resilient arrangement is variably secured to a tremolo, integrated into the fulcrum tremolo spring block and related support tremolo innovations. Each of these arrangements providing a variable elastic pre-load installed on the instrument and meeting the variable force of tension requirements.

The General Background of the Invention indicates not only the use of more common resilient elements like coil springs, etc. in devices secured to the spring pocket, etc. but also the magnetic elements in otherwise similar apparatuses to create a variable force of tension to enforce or stabilize a tremolo, page 13: "The Mag-Lok from Super-Vee Tremolos, secured to the spring pocket, US patent pending, is a magnet-based alternative to the compression spring arrangement to ensure the tremolo in initial position during double stop bends and the like that is overcome when the bar is used."

Magnetic fields of two matching poles in proximity to each other exert a force in the direction of the poles, to repel each other like the ends of a compression spring and, conversely, magnetic fields of two mismatched poles in proximity to each other exert a force to attract each other on the axis of the poles like an expansion spring. Varying the relative distance between magnetic elements in proximity varies the torque they exert on each other to create a variable resilient magnetic force.

Claims 1-10 are divisional and are directed to for the use of magnetic elements for stabilizing or creating the biasing element for enforcing and/or establishing and maintaining initial position of the tremolo at time of initial setup. The elasticity of the force of tension between magnetic elements in proximity mimic the spring's resilient behavior operable to form an elastic pre-load in the apparatus accordingly. The apparatuses are modified for the characteristic and structure of the magnets.

Claims for a Continuation In Part: "an application . . . repealing some substantial portion or all of the earlier non-provisional application and adding matter not disclosed in the said earlier non-provisional application".

Claims 11-20 comprise new material directed to Headpiece Tuner improvements for primarily headless guitar and basses, etc. that include two versions of individual string clamps or clamp/cutter arrangements, a bi-directional string loading capacity, a truss rod extension thumbwheel element and a removable cross-bar addition to facilitate turning the truss rod extension thumbwheel element, modify the tone and acoustic response of the neck and store as a stand support.

The Headpiece Tuner supports a greater integration with other tuning innovations, for example, the axis of the thumbwheel of the Headpiece Tuner alignment following the truss rod are generally points to the axis of the thumbwheel of the Global Tuner and both work, under variable force of tension, cooperatively with the variable force of tension of the strings to maintain the optimal playing condition achieved at "initial setup". The choice of weight/material of the Headpiece handle, can be fine tuned to achieve a desired response from the neck, in view of individual players' choices of setup, etc. ie., the weight and tension of the strings, to modify the tonality and sensitivity.

The General Background of the Invention of the parent application has been embellished with additional phrases, etc. to support the subject matter more clearly; the section on the Mag-lok [p. 18-19] has been expanded to introduce claim terms and detail related concepts.

In the Summary Of the Invention, The Headpiece Tuner section has been added [pp. 20-24] as well as Magnetic Stabilizers/Stabilizer Tuners [pp. 24-27] sections to support claims.

Claim 21 is an independent claim for a string musical instrument incorporating the various innovations.

Amended figures based on the figures from the parent application and new figures for the new matter are included. Description of the Drawings has been amended accordingly.

GENERAL BACKGROUND OF THE INVENTION

In a stringed musical instrument, such as a guitar, the strings, placed under tension, extend unsupported between a first critical point usually formed by the nut positioned where the neck joins the head and a second critical point usually formed by a clearly defined point on the bridge positioned on the body. The strings are secured or fixed at one end on the body of the instrument to what is traditionally known as the tailpiece, strung over the bridge and extended past the nut at the transition from the neck instrument to the head, and, for conventional instruments, secured at the other end to the tuning pegs where a string is tensioned and adjusted to a tuned pitched condition, tensioned for play, or, simply, tuned condition. The neck further comprises a fingerboard or fret board that a player presses the strings against to play various pitches up and down the neck; the fingerboard typically is formed with a convex radius that commonly varies between 9" and 20".

The second critical point can be created as a part of a bridge or combined bridge and tailpiece structure. Traditionally, the size of the bridge element is quite small so as to create a clearly defined single point of contact between the string and the bridge element. It is between these two points that the playable string length is typically determined, sometimes referred to as the scale length or harmonic length. Adjusting the relative distance between the first and second critical points is called harmonic tuning or setting the intonation. Some bridges structures are individually adjustable, that is for each string, relative to the nut for achieving a more precise harmonic tuning. Usually this adjustment of the second critical point for harmonic tuning is carried out first and then the strings of the instrument are tuned to playing pitch. Often referred to as part of the "initial setup", it is not uncommon that further adjustment of the harmonic tuning is necessary for a variety of reasons, for example, including changing the brand of a string where the alloy of the strings is varied or when the gauge of strings the player chooses changes as well as "setting" the string by manually pulling on the string along the scale length in order to improve elasticity in the string at first tensioning before the string can confidently relied on to hold proper playing pitch during the life of the string.

Often the typical construction of the strings, particularly for guitar and bass, includes a plain end and, on the other end, a "ball end" which being a washer-like addition is wrapped by the string itself into a larger form to enable "fixing" or securing the string on the instrument to the tailpiece element; alternatives to the "ball end" include as known to those of ordinary skill in the art as "bullet ends" formed from metal and molded around the end of the string. The tailpiece is usually provides for an opening or recess sufficient in size to receive the strings of various diameters ranging from 0.007" to 0.070" or more while being smaller than the diameter of the ball end so as to limit the passing of the ball end through the opening or recess in order to secure or mount each of the individual strings to the body. The wrapping usually extends up to a ½" towards the plain end and as such the position of the tailpiece structure relative to the bridge element must insure that the wrapping does not extend over the second critical point when arranged on the instrument; this wrapping, under normal circumstances, is not subject to stretch compared to the rest of the string. In the relevant art, "anchoring" strings is often referred to as attaching or securing a string and understood with the limitation that the anchoring is sufficient so that the string is fixedly attached or secured to the instrument under the typical tensioned conditions of the string that typically range from 16 to 20 lbs or greater. Stable fine adjustments of these and other elements have been a longstanding problem for stringed musical instruments.

Additionally, the popularity of guitars and other multi-stringed instruments having more than the typical 6 strings and/or using longer scale lengths, etc. are capable of a greater pitch range which creates the need for strings of a larger diameter. One solution is to utilize "taper core strings" that have one or two less layers of wrap near the "ball end" of the string to go over the bridge elements. Further, a "taper wound" string simply tapers away these layers of wrap as near the ball-end of the string, so the part that goes over the bridge has a smaller diameter. "Exposed core" strings taper down to the core itself, so the core goes over the bridge and lowers the action and increases sustain/resonance. These designs are often seen on B strings, typically a low string on a five string bass, for example. The logic is that a taper core string, etc. approach will help with intonating a larger diameter string. In some of these cases the strings are mounted to tailpiece portion by inserting the string through or over the bridge elements to avoid complications due to increased string diameter. The larger diameters can be problematic given the dimensions of vintage systems.

Playing pitch or proper playing pitch or pitched string condition is generally understood by one of ordinary skill in the art to be the proper pitch of a guitar string relative to the remaining guitar strings when a guitar is played "in tune." For example, in a standard tuning arrangement, for a six string guitar, based on the standard A=440 Hz, the playing pitch of the $1^{st}$ string (highest) is tuned to note E (329.63 Hz), the playing pitch of the $2^{nd}$ string is tuned to note B (294.94 Hz), the playing pitch of the $3^{rd}$ string is tuned to note G (196.00 Hz), the playing pitch of the $4^{th}$ string is tuned to note d (146.83 Hz), the playing pitch of the $5^{th}$ string is tuned to note A (110 Hz), and the playing pitch of the $6^{th}$ string is tuned to note E (82.41 Hz).

Modern expression of tuning pegs have evolved to include to additional features incorporated into the turning of the tuning pegs such as the capacity to either clamp the string and/or cut the string after first inserting the associated string through the traditional cross opening in the tuner post—in some cases, tuning pegs are fashioned to do both. Tuners on the peg head include an assembly that comprises a cutting edge and cooperative cutting surface that cuts the string during initial rotation.

Other iterations of the guitar have included the "headless guitar" wherein the end of the instrument's head is truncated, obviating the traditional tuners, creating a design requirement forming a headless nut or "headpiece" arrangement to both 1) support the individual strings transverse the direction of the neck following the radius of the fingerboard at the end of the neck and 2) secure each string on the other side of the nut element from the tailpiece, for example, so the strings can be otherwise tensioned to pitch by tuners on the body. The strings are inserted through the headpiece or nut arrangement and fixedly secured at the end of the neck beyond the nut. Steinberger created double ball end strings and followed by Floyd Rose created double "bullet-end" strings to eliminate the cut string end issue.

The first truss rod patent was applied for by Thaddeus McHugh, an employee of the Gibson company, in 1921, though the idea of a "truss rod" appears in patents as early as 1908. Most electric and acoustic guitar as well as basses and other stringed musical instruments include an "truss rod", an one- or two-piece adjustable metal rod that goes down the inside of the center of the neck, beneath the fingerboard, to balance the force of tension exerted by the [collective] "string pull" tending to increase the "bow" in the neck against the force of tension exerted by the truss rod by tightening the truss rod nut to decrease the bow or relief and to, thereby, stabilize the lengthwise forward curvature and, adjust the "relief" of the neck.

The truss rod further comprises a nut located at one end, usually at the headstock, under a cosmetic plate with typically three small screws mounting a cover positioned just behind the nut, or where the neck joins the body. The cap or nut usually has a hex shape to either receive a 4 mm hex wrench or a 5/16/10 mm hex nut driver, for example, wherein inserting the appropriate hex-drive tool to rotate the truss-rod cap within a range of, say, a ¼ turn in either direction is more than adequate in most instances—turn clockwise, to tighten and flatten, to reduce "relief" and improve ease of pressing strings, ie, "action"; and turn counterclockwise to loosen and add a slight concave curvature to add "relief" so the strings have more room to vibrate above the frets. When instrument is exposed to environmental elements over time, temperature and humidity swings, such as when seasons change, or often daily or weekly, depending on conditions, which alters the "initial position" of the neck relief from that at the time of "initial setup", not only altering, the intonation, but also making notes sound "buzzy" or make the action firmer and harder to fret.

However, the typical headless design leaves the truss rod cap exposed, extending through the greater part of the length of the neck, underneath the e d of the headless nut arrangement, for an advantage those players enjoy. There are no current designs for the headless nut that integrate the headpiece with a truss rod tuner to adjust for the truss rod "on-the-fly", > "This combo headpiece is a beautiful design for headless guitars, as it allows the player to use either double ball-end strings or standard single ball-end strings . . . it has a center opening for truss-rod equipped necks . . . . Easy to install and ships complete with mounting screws and allen wrench." http://www.headlessusa.com/j custom-headpiece "The truss rod access hole is very close to where the neck plane 'shelf' is (assuming a ¼" thick fretboard). This headpiece is intended to match spec, re Steinberger-style necks. So I will have to angle the headpiece downward to line up with the location of my Stew-Mac Hot Rod adjuster, centered ~8.5 mm below the neck plane surface . . . ." http://www.projectguitar.com/forums/topic/46474-headless-bridge-and-headpiece grounding/

Accessing the truss rod cap to tune the "neck" back to "initial position" with the hex-based tool can be cumbersome, due mostly to implementation as discussed above, and can cause lengthy delays—accordingly, adjustment of relief is often an overlooked aspect in daily consideration for maintaining the tuned condition of the instrument.

In the Proelsdorfer U.S. Pat. No. 2,304,597, string tensioning devices placed on the tailpiece for fine tuning the pitch of the strings of violins, guitars and the like, were disclosed; such pitch adjustment is quite limited in range, comprising generally an interval falling between that of a whole tone and a major third at best, and designed to offer the tuning of the strings a minor adjustment of pitch after the general tuning is achieved with the tuning pegs on the head of the instrument which traditionally first provides for raising and adjusting the tension of the strings to pitch from an untensioned condition and then setting the string. This is regarded as fine tuning and the apparatus for doing so, the "fine tuners", usually comprise an adjustment knob or thumb screw.

It is known to those skilled in stringed musical instrument design and construction that various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the fulcrum tremolo, first introduced in Fender U.S. Pat. No. 2,741,146 ("Fender '146") shows and provides a device comprising a novel structure, which incorporates the bridge and the tailpiece. The portion supporting the bridge elements is called the bridge plate or the base plate. Further, both the bridge and the tailpiece elements connected to the base plate both move together as the fulcrum tremolo device is pivoted. Typically, in order to facilitate the fulcrum tremolo pivoting about its fulcrum axis, counter springs, as a biasing element, are utilized to counteract or counter balance the pull of the strings created by the collective tension of the strings at playing pitch. Accordingly, a singular and defining aspect of the fulcrum tremolo is that the harmonic tuning is upset as the device is pivoted; and, accordingly, for an instrument equipped with a fulcrum tremolo, it is unique in that only restoring all of the strings to the pitched condition at the time of initial setup also simultaneously restores the harmonic tuning for all the strings. The base plate upon which the individual bridge elements are adjustably secured has a beveled ridge portion which is secured to the instrument body by six screws permitting pivotal movement about a fulcrum axis which varies the tension on the strings and produces the desired "tremolo effect"; in general, this device allowed for extensive dropping down of the pitch of all the strings and a modest upward capacity that further enabled the familiar mild pedal steel or Hawaiian guitar vibrato effect provided in gentle pivoting.

In this first vintage fulcrum tremolo, herein referred to as Type I, the metal bridge elements of Fender '146 are loosely held in place by a spring loaded attachment screw arrangement pivotally secured through openings in a small folded portion of the base plate farthest from the fulcrum axis. The bridge elements also incorporate set screws for varying the relative height of the bridge elements and, therefore, height of the respective second critical points relative to the base plate and by extension, to the body and neck.

The fulcrum tremolo is generally defined to have a base plate pivotally mounted to the body of the instrument and an "inertia block" or "tone block" or "spring block" that extends transverse the direction of the strings 90° to the base plate. The instrument body is fashioned to include a single body cavity comprising two distinctive sections. There is 1) an approximate 3.00"×1.00", generally rectangular, transverse the direction of the strings, traditional "tremolo pocket" or "trem pocket" extending generally perpendicular from the top surface of the body to meet at 90° providing two approximate 3.00" wide opposing faces, a first face closer the nut and a second face further the nut; and 2) the traditional, generally rectangular, approximate 4.00"×2.25"×0.775" deep, cutout extending in the direction of the strings in the back of the instrument body, a "spring pocket", to receive the spring arrangement. The spring block has a first surface closet the nut and a second surface, each surface generally perpendicular to the top of the instrument and generally parallel to the tremolo pocket first and second face. Although there are differences in specifications from one instrument manufacturer to another for the various designs of the fulcrum tremolos that are available, there is approximately 0.125" to 0.250" clearance, between the spring block and the tremolo pocket face closest to the nut, to provide for upward pitch change as the spring block pivots towards the nut. Counter springs are usually connected to the body of the instrument at one end and, on the other end, to a separate spring attachment means transverse the base plate, usually a block of metal, milled or cast or a combination of the two, which being secured to the bottom of the base plate by three screws 90 degrees to the base plate, is often called a spring block or inertia block.

The typical spring arrangement includes, in addition to the biasing springs connected to the spring block, a "spring claw" to receive the other end of the biasing element secured by two wood screws to adjust the position of the spring claw relative to the body for a simple but cumbersome adjustment method. There is ample room for the spring block to pivot freely within the "tremolo pocket" cavity during use.

One of the most troublesome problems with prior art for the fulcrum tremolo has been maintaining the "initial position" of the tremolo achieved at "initial setup" when all the strings are brought to proper playing pitch as the harmonic tuning is achieved. When a musician plays on the string there is usually some kind of string stretch over time that results in the overall tuning, and thereby, the "initial position" of the tremolo going out of balance. Specifically, when the pitch of the string changes, the position of the fulcrum tremolo and the position of the second critical point relative to the nut changes which then instantly alters the harmonic tuning. This is especially problematic if a string breaks with this type of tremolo; since the missing force otherwise created by the tension of the broken string allows the entire tremolo to be subject to the known "backward tilt", all the remaining strings are un-manageably sharp in pitch and the harmonic relationship to the fret placement and scale length is distorted, generally, to an undesirable degree. Furthermore, when the tremolo base plate tilts forward, the spring block tilts away from the nut; and when the tremolo base plate tilts rearward, the spring block tilts towards the nut.

This singular characteristic adds complexities in obtaining the primary goal of achieving a stable equilibrium, initial position, between the force of the tension provided by the use of two to five biasing or counter springs (connecting between the tremolo and the body) in relation to the force of tension of all the strings (connected to the fulcrum tremolo and the end of the neck at the peg head by the tuning pegs or an optional nut arrangement that secures the strings without tuning pegs, etc. at the end of a headless neck).

Accordingly, these and other inherences need to be addressed in achieving a true and lasting initial position for the fulcrum tremolo and has been the object of many inventions. In this inherent inter-dependant system of tensioning forces, contrary to the requirements of other tremolo or fixed bridge arrangements, (in the ideal instance where the essential conditions of the initial setup have been established and the appropriate tensioning force of the springs provisioned), the precise tensioning to proper playing pitch for any less than the total number of strings will inherently fail to achieve pitch and harmonic tuning for all of those strings attached to the tremolo.

Often the pivot is subject to wear and the tremolo does not always return to its initial position. Great care is required to establish the initial position, since both aspects of adjustment are interactive for "floating tremolo setups", and since it simultaneously provides both the proper harmonic tuning and proper pitch tuning for each of the individual strings in order to enable a lasting "initial setup".

Therefore, for stringed musical instruments, as is known to those skilled in the art:

- The second critical point is a clearly defined point on the bridge or individual bridge elements, the adjustment of which relative to the first critical point on the nut defines the length of the string or scale length and the adjustment of which is called harmonic tuning.
- For fulcrum tremolos as originated by Fender U.S. Pat. No. 2,741,146, when pivoted:
- Both the bridge portions and the string anchoring means, the tailpiece, simultaneously move about a common fulcrum axis;
- The harmonic tuning is upset and is only restored when all strings are at proper playing pitch;
- The tuning pegs or other means of tensioning the strings are inter-dependant with each other in obtaining initial position; and
- Various factors can disturb the equilibrium point between the tension of the strings and the tension of the counter springs and as a consequence disturb the initial position.

For those fulcrum tremolos equipped with fine tuners as with Rose U.S. Pat. No. 4,497,236, Storey U.S. Pat. No. 4,472,750 and Fender U.S. Pat. No. 4,724,737:

- The bridge and tailpiece portions simultaneously move about the fulcrum axis when the device is pivoted for the tremolo effect;
- The fine tuner screws simultaneously move with the bridge and tailpiece portions about the tuning axis when fine tuning; and
- Fine tuners are designed to offer the tuning of the strings a minor adjustment of pitch after the general tuning is first achieved, typically, by the tuning pegs on the head of the instrument; and
- Adjusting the tension of a string by the fine tuner knob alone simultaneously adjusts the harmonic and pitch tuning and can achieve tuning a string to proper pitch conditions while simultaneously achieving proper harmonic tuning.

Knife Edge Pivots for the Fulcrum Tremolo

Rose (U.S. Pat. No. 4,171,661) shows adopting a novel shaped beveled edge to the base plate, called a "knife edge", adjustably supported by two screw-like members, referred to generally as riser posts, positioned in the body to collectively improve the return to initial position after pivoting the fulcrum tremolo device. The knife edge fulcrum pivot arrangement provides for the base plate to be positioned generally parallel to the instrument body, often referred to as a "floating tremolo", for example, and offered the novel possibility to substantively increase the tension of the string for upward pitch changes by rocking the base plate "rearward towards the body" with the arm. The inclusion of iterations of Fender '146, herein referred to as Type I, to include, similar to Rose, a knife-edge design on the leading edge, closest to the nut, of the base plate with a riser post arrangement adjustably connected to the fulcrum tremolo, herein referred to as Type II.

These two vintage fulcrum tremolos of the last century, Fender in the 50's and Rose in the 70/80's, are in part distinguished by the differing standards for the placement of the riser posts, that receive each of the knife-edges to create a pivot axis, relative to both first critical point on the nut as well as the second critical point on the bridge element. Accordingly, there are differences in the body pocket but less so for the cutout that receives the biasing springs and the distance from the face of the spring block nearest the nut to the corresponding face of the tremolo pocket.

String Locks and Clamping Nuts for the Fulcrum Tremolo

Improvements to the Fender '146 fulcrum tremolo have included "string clamps" at the nut, installed along with a "string tree" for some guitars, a horizontal bar positioned between the tuners and the "locking nut" arrangement, to facilitate stability and "string clamps" at a point on the opposite side of the intonation point or second critical point on each of the bridge elements relative to the nut in order to limit string stretch to the prime vibratory portion of the string within these two points defining the scale length.

U.S. Pat. No. 4,171,661, Floyd D. Rose, "Guitar tremolo method and apparatus", issued 1979 Oct. 23 ('661):

> It is important, however, to also have restraining of the strings at the nut 13 . . . . In use, the guitar will first be tuned as desired, by customary means (15) and while the restraining devices at both ends are loose. When the guitar is completely tuned according to the desired use, the restraining devices at both ends will be tightened so as to maintain the tension between the bridge and the nut at a consistent and proper tension and will not allow sliding of the strings over either the nut or bridge position.

The '661 string clamps included a nut formed into a base; the arrangement offered in several configurations comprising several string radii, such as 9", 10" 12", etc. to match the bridge and fingerboard radius. The base is approximately 0.600'× the width of the guitar neck it is to be installed on, and, further formed to receive three screws and associated clamp pads threadedly connected to the base in order to clamp strings in pairs, that is two strings were clamped by each screw/pad arrangement. The neck area that supports the nut is typically modified to form a 0.600" shelf, cut to receive the depth of the base, so that the nut portion supports the strings over the fingerboard at the preferred string height as part of initial setup. The back of end of the neck is further modified with two openings transverse the direction of the strings to receive each a bolt that is threadedly secured to the bottom of the base to secure the nut arrangement to the guitar.

In Steinberger, double-ball end strings were developed wherein one ball-end was placed in a recess in a nut arrangement secured at the end of the headless neck and the other ball-end placed in a recess in the tremolo on the body; the tremolo included tuners to tension the string to playing pitch—no locks or clamps were used.

Floyd Rose SpeedLoader nut is a redesign of the Rose clamping nut to fit the 0.600" pattern, developed 1995-1999, and introduced around 2003 that combines Floyd Rose Original with the SpeedLoader system, that requires special strings and is manufactured under license of McCabe US Patents. The SpeedLoader strings are a variation on the Steinberger strings that replaced the ball-end with bullet-like additions in a pre-cut length fitting only for the Speedloader system. Rose U.S. Pat. No. 5,945,615—August 1995. The Speedloader bullet-like ends are placed in individual recesses in the nut arrangement to secure the stings under tension.

It is reported that recently, Gibson USA applied for a US patent for the Zero-Fret Adjustable Nut: "However, the Zero-Fret Adjustable Nut (patent applied for) . . . isn't like any other zero-fret nut because it's adjustable which offers some major advantages. Two 0.050 Allen screws (accessible between the 1st and 2nd strings and the 5th and 6th strings) adjust the nut's height and angle, so you can customize the action on both the bridge and nut ends of the strings." [http://www.gibson.com/news-lifestyle/features/en-us/how-to-customize-action-with-gibson.aspx] Further, Warwick in Germany provides a similar arrangement, "Just a Nut III" (2007-2010)—"We have discovered Tedura polymer strengthened with fiberglass, whose outstanding abilities to transmit vibration was proven in laboratory tests, which then became the basis for further tests revealing that Tedur is extraordinarily resistant against breakage and wear. With that, Tedur has fulfilled all the expectations we've placed on a modern nut." [http://www.warwick.de/en/Warwick---Support--FAQ--Just-a-Nut.html]

Concurrently, headless guitars were developed as discussed above; the headpiece serving to secure the strings at the nut in the instance of no tuning pegs—to adapt the Rose approach, to use the clamp pad and associated tightening screw, for each string individually, has been shown by many luthiers.

Further, an Intonation Adjustable Nut™ for guitar, U.S. Pat. No. 8,76,559, provides for a simple intonation adjustment that replaces the traditional nut or zero fret, designed for headless acoustic or electric guitars in the vintage standard with body mounted tuners, begun with, Steinberger, extended to Strandberg, ABM, Bondy and other luthiers, such as Rick Toone, for example, for placing a locking nut on the guitar neck.

Further, in "Locking Nut Assembly For A Guitar", U.S. Pat. No. 4,579,033 A, William H. Edwards (1986) a variation on the one clamp pad per two strings taught by Rose '661 that replaced the clamping screw with a cam-based lever and screw arrangement with an open or unlocked position for threading the string and a locked or closed position for securing the string. The adjusting the screw is operable to adjust the position of the lever relative to the base so the cam lobe presses against the clamp pad to secure the string when in a closed or locked position.

(Abstract):

> A finger operated locking nut assembly for a stringed instrument is provided including a baseplate for separating and maintaining the strings over the fretboard, locking block for pressing the strings against the baseplate and a cam action lock screw. The lock screw provides a first, unlocked position for allowing the strings to slide for tuning of the instrument and a second, locked position for maintaining the tune of the instrument during play. The preferred lock screw includes a threaded body to allow rough adjustment and a transverse head bifurcating a pivoting lever tab to define spaced cams. These cams provide spaced contact points across the block for even pressure and secure locking of the strings.

Historically, other approaches to securing the string at the nut, a headpiece, utilize a "regular" string, ie., one pain end and one ball end. Some headpieces provided for ball-end recesses and/or string clamps for the plain ends to secure the string at the end of the neck, immediately beyond the nut.

The Stopped Tremolo

It is also known that many musicians, despite having the requisite hardware on their stringed instrument to enable a "floating tremolo" setup, intentionally choose to "block" or "stop" the fulcrum tremolo from being tilted "rearward" in order to remove the potential for an unwanted increase in pitch of the strings. This condition or setup is commonly referred to as a "blocked tremolo" or "stopped tremolo"—accordingly, the stop is considered a "hard" stop when it completely prevents pivoting the tremolo in one direction when at initial position. Additionally, as a significant part of this setup, increasing the overall tension of the biasing element past the minimum force required to make initial contact with a "hard" stop at initial position, is required to compensate for the increases in force in the tension string during bending notes, etc. meeting at least three objectives: 1) when a string breaks, the tremolo stop will ensure initial position, so that tremolo does not tip rearward and the rest of the strings do not go up in pitch, despite the missing counter balancing force of the un-tensioned or broken string, 2) ensuring the tremolo returns to initial position after radical use no matter what—to eliminate, among other things indigenous to the floating tremolo, the maintenance and care of initial position over time defined by the delicate balance of the forces and related wear and tear over time and 3) to make the tremolo less likely to be activated unintentionally compared to a floating tremolo, useful in general, for strumming, and makes double stops much more accessible when the force of the biasing element is increased. Tremolo stops of this nature have been created by small pieces of wood, plastic, etc. approximately 0.125" ~0.250 or so thick which have been placed in the tremolo pocket between the spring block and the face of the tremolo pocket closest to the nut—even in "emergency" situations, a stack of guitar picks taped to the inertia block's face closest to the nut, in sufficient dimensions, can used for an evening, if need be.

Further, stopping a floating tremolo is common to meet the demands of auxiliary tension adjustment mechanisms: U.S. Pat. No. 5,359,144 ("'144") October 1994 to Robert Benson. Commercialized as the "D-tuna" mechanism for the "double-locking" Floyd Rose tremolos, the mechanism is designed to quickly re-tension the $6^{th}$ string from standard "E" down a whole step to "D" for "drop-tunings", i.e., instances where the pitch of at least one string is varied compared to standard tuning—the dynamics of the forces of tension between the strings and springs require, for optimal usage, a stopped tremolo:

A pitch changing apparatus, providing bi-stable operation within a tremolo system which produces two distinct pitches for selected strings . . . .

In the Abstract:

The tension correcting mechanism is manually rotated to adjustable stop positions of required spring counter-tension, thereby keeping all strings in tune under conditions of changed total string tension.

Van Halen: (http://www.dtuna.com/faq.php):

Why do the other strings go out of tune when I drop to D?

The bridge must be stabilized first. This is done by blocking the bridge so it cannot pull up. If your bridge is stabilized and the other strings are still going out of tune, you may need to increase the overall "spring tension" by moving the spring claw further from the block.

Accordingly, it is recommended by Van Halen that the "D-Tuna" device of '144 works better with an additional element or mechanism that will provide a "hard" stop the tremolo when the $6^{th}$ string is tuned to "D", the lower of the two target pitches; and, in order to ensure initial position of the fulcrum tremolo at the higher target pitch, since a hard stop requires increasing the overall force of the biasing element sufficient to compensate for the small increase in force, which unaddressed would yield a forward tilt otherwise present at the higher-tensioned "E" target pitch.

Floating Tremolo and Tremolo Stabilizers

One disadvantage, for some players, is that a "hard" stop eliminates the original capacity for light tremolo wavering effects around initial position and upward pitch bends. Accordingly, many players today would prefer a setup that acts like a fixed bridge for small force changes like bending strings, strumming at initial position yet "gives" and acts like a floating tremolo for using the tremolo arm for larger modern, pitch changes, such as "dive bombs", as is distinguished as a "soft" stop or tremolo stabilizer. As is known, the biasing element or spring system, provides a continuous generally linear force curve to establish equilibrium at initial position, but is not capable of changing its rate of tension, in general, stretching gradually and gradually as more force is applied.

Various mechanisms have been presented to assist the traditional biasing springs of Fender '146 in view of modern demands, such as the Hipshot branded "Tremsetter", Borisoff et al, U.S. Pat. No. 4,928,564 ("'564"). The Tremsetter device secured directly to the body's spring pocket, provides an adjustable pre-tensioned compression spring element added to complement the traditional biasing element to provide a discontinuous force curve exerted on the tremolo in order to provide an adjustable "soft" stop or tremolo stabilizer—the spring arrangement operable to increase the force required to pivot the fulcrum tremolo from initial position; its operability primarily to more firmly maintain the initial position of the floating tremolo compared to usage with an unassisted biasing element. Accordingly, when a force is exerted to move the tremolo out of initial position, that same tremolo is subject to a restoring force that is being borne by the stabilizing device limited enough in its range so that the compression spring element is active until the pre-tensioned restoring force is overcome during operation of the tremolo.

The Hipshot device and multi-spring variations like it, the Ibanez BackStop, the WD Tremolo Stabilizer, the ESP Arming Adjuster, the Goeldo BackBox, not all of which are available in the US at this time, none-the-less all comprise a compression spring-like arrangement deployed to complement the traditional biasing element, each secured to the tremolo spring pocket, tensioned upon installation to an approximate force of 8~10 pounds, capable of making variable contact with the spring block and urging the spring block in a direction away from the nut—these devices do not pivot with the tremolo about its axis—it requires approximately 4 pounds of force to "bend" a typical electric guitar unwound string a whole tone up in pitch under typical situations, 8 pounds or so of force will reinforce or ensure initial position under the conditions where two strings are bent.

Each such device employs a tensioned compression spring that seeks to stabilize initial position with an adjustable "soft" stop, to avoid the limitations of a 'hard" stop and to offer more stability in the instance of double stops which are otherwise more difficult:

A method of stabilizing a neutral position of a tremolo system including a pivoted bridge assembly including the steps of tensioning all of the strings of a guitar to a selected pitch slightly less than a desired pitch, tensioning certain counter-balance springs connected between said bridge assembly and the guitar body to oppose the string tension, and mechanically adjusting a certain counter-balance spring to bring the tension in the guitar strings to a desired pitch whereby said mechanical adjustment provides a mechanical stop for returning all of the guitar strings to a selected pre-tuned pitch.

Numerous other complementary mechanisms are secured to the tremolo spring pocket to enforce the position of the spring block such as Hirayama U.S. Pat. Nos. 6,552,252 and 6,686,524 for Ibanez include auxiliary springs to enforce initial position. Geier U.S. Pat. No. 7,427,703 commercialized as the "Tremol-no" releasable tremolo stop is also secured to the tremolo spring pocket in the body:

A quick-release tremolo lock device for installation into a tremolo recess, and for mounting to a movable bridge or a tremolo block of a stringed instrument such as a guitar. The tremolo lock device includes a spring mount that is adapted to be fixedly attached to at least one wall of the tremolo recess and configured to capture an end of at least one tremolo spring. A slide key is also incorporated into the device, which is connected to the spring mount about a proximate portion of the slide key. The device also includes an adjustable quick release slide receiver that is adapted to receive and to releasably capture a distal portion of the slide key to fix the position of the receiver relative to the slide key. The device further includes a tail piece joined to the quick release slide receiver and configured to be mounted in a spring hole of the tremolo block.

Lavineway U.S. Pat. No. 7,189,90 is provides a tension bar connected to the body operable on the spring block to ensure initial position:

A tension bar is held against the back of a lower portion of the tone block by at least one tension bar spring when the tone block is in a neutral position. Stopping means are provided to prevent the tension bar from urging the tone block forward of the neutral position.

The Mag-Lok from Super-Vee Tremolos, US patent pending, is another stabilizer device for the fulcrum tremolo that includes a magnet-based alternative to achieve the elasticity of the compression spring. In this case, the Mag-Lok provides a variable resilient force of tension, in the otherwise typical design, following the same mounting arrangement as the group of coil spring stabilizers discussed above, ie., secured to the spring pocket, variably contacting the end of tremolo spring block to exert a variable magnetic force, in the direction away from the nut, to comprise a second force of tension. The second force of tension to complement the tremolo springs first force of tension and adjustably ensure the tremolo at initial position during double stop bends and the like and, which otherwise, can be further overcome when the tremolo arm is used.

All elements exhibit some form of magnetic property. Only three magnetic elements, iron, nickel and cobalt including neodymium show properties of ferromagnetism. [ie., the capacity of remaining permanently magnetized]. Magnetic force results from electrically charged elementary particles called electrons. Electrons are always in motion. Magnetism or magnetic force is an elastic push or a pull, attraction or repulsion, between a charged magnetic element and a second magnetic element at a distance or proximity due to the inherent characteristics of a magnetic field. This magnetic field providing directional torque in the space around it comprising directional poles, ie "North" or "South", 1) elastic attracting or repelling other magnetic elements objects or 2) aligning itself on a directional or polar axis to an external magnetic field and 3) providing a relative magnitude of the elastic magnetic force based on relative proximity. Magnetic fields of two matching poles aligned to each other in proximity to each other exert a force in the direction of the poles, to repel each other like the ends of a compression spring and, conversely, magnetic fields of two mismatched poles aligned to each other in proximity to each other exert an elastic force to attract each other on the axis of the poles like an expansion spring. Varying the relative distance between magnetic elements in proximity varies the torque they exert on each other to create a variable magnetic force.

Smith U.S. Pat. No. 9,029,671 provides for a device secured to the "upper surface of the body" adjustably connected to the tremolo base plate operable to selectively stop a floating tremolo:

A tremolo lock as provided preferably to allow the operator to engage the lock or stop from the topside of a guitar and tremolo base plate completing a floating double locking tremolo system preferably for electric guitars.

The Hipshot Tremsetter is also known with the D-tuna in order to improve the accuracy of the pre-determined target pitches for a floating tremolo. Dam's U.S. Pat. No. 7,053,287, also secured to the body's spring pocket, for a similar device secured to the spring pocket for creating a soft stop include:

A compensator for a tremolo for a stringed musical instrument, such as an electric guitar. The compensator has an integrated tremolo stop, allowing a musician to continue playing without undue delay in the event a string breaks.

Further,

The object of the present invention is to provide a compensator having an integrated tremolo stop which allows the musician to resume playing with a minimum of delay after string breakage, and to provide ready access to the tremolo stop while keeping the number and size of the openings as small as possible.

Didan U.S. Pat. No. 6,943,284 September 2005 for a retractable tremolo stop mechanism comprising a retractable cam adjustably secured to the top body surface bracketed between the spring block and the base plate:

. . . , having a first inoperative position and a second operative position in which it stabilizes the bridge plate by limiting movement of the bridge plate in one direction in response to the spring means, means for maintaining said canny in said first position and said second position comprising of a frictional restraint in contact with said cam, method for establishing the normal position of the bridge, The cam is selectively operable by the player between an inoperative (retracted) position, and an operative position in which it serves to stabilize the bridge plate.

The cam is pre-set with a limit stop whereby its actuation stabilizes the bridge plate at a position providing for normal tune of the remaining strings despite the failure of any one or more strings, or for purposes of tuning the instrument.

Rose U.S. Pat. No. 8,946,529, February 2013, apparatus includes a modification of his fulcrum tremolo for top mounted Gibson-style applications to include a re-enforcing element for initial position—this design obviates the traditional spring block that pivots within the body of the instrument and the biasing element arrangement:

The apparatus includes a mounting frame configured for mounting on the surface of the body of the instrument, an attachment post secured to the body, a base plate pivotally mounted with respect to the attachment post and having a surface adapted to receive a force, a mounting assembly mounted on the base plate for holding a string of the instrument, and a first resilient member assembly for engagement with the mounting frame outside the body of the instrument and supplying a stabilizing force to the base plate against a tension force in the string. The apparatus includes a second resilient member assembly configured to be engaged with the mounting frame outside the body of the instrument and to supply a force to the base plate surface adapted to receive the force.

As discussed above all of the various compression spring based mechanisms described above are secured to the body, in the spring pocket, in particular, and, accordingly, do not rotate with the tremolo at any time, to make variable unsecured contact with the spring block to apply an expanding force supplied by compression springs against the spring block in a direction way from the nut to augment the linear force applied by the biasing element pulling in the direction towards the nut. In each case the adjustment members are very small, often positioned between the individual springs of the biasing element and difficult to adjust initially and to compensate for changes over time.

The Global Tuner invention offers a quick way to adjust the dynamic relationship between tensioning forces between the strings and springs with a thumbwheel to maintain "initial position" over time. The typical Global Tuner splits the tremolo's inertia or spring block into two sections transverse the direction of the counter springs. One section is a base element or main block that is connected to the tremolo base plate and the other section comprises a holder element connected to the biasing element or counter springs, in a format that is connected to the main block and which is, in either case, adjusted by a thumbwheel arrangement. Since acoustic coupling is best in the instance of the greatest contact between the associated parts, when the spring holder element is slideably positioned within, say, 0.031" of the base element, a first position, when the assembled parts have the greatest contact area to each other. Threading the thumbwheel to variably position the holder element in either direction will restore initial position under normal conditions while maintaining the best coupling for this design.

The Global Tuner provides a variable adjustment mechanism invention that neither meets the requirements to achieve a stopped initial position nor a "soft" stopped initial position—the need for a stable and adjustable tremolo stop tuner is clear.

SUMMARY OF THE INVENTION

The Headpiece Tuner

The Headpiece Tuner comprises a housing secured to the end of the "headless" neck integrating an 1) an adjustable removable nut portion, in various sizes to accommodate various fingerboard radii, for individually supporting the string at the end of the neck, 2) an internal screw adjustment element for varying the Headpiece Tuner housing's position relative end of the neck addressing variances in setup requirements, 3) two approaches to an individual string clamp arrangements to secure an associated string, 4) an interior recess, sufficient in size for either clamping design to a) clamp a pre-cut string and safely keep the sharp ends of cut strings out of the way or b) clamp and cut the end of the string to size by pivoting a lever, the lever formed with either a pivot slot or cam and a set screw arrangement for adjustment to various string gages, 5) a truss rod access port so that a hex wrench, for example, can be inserted into the truss rod arrangement for adjustment and, further, 6) the truss rod adjustment aspect comprising a thumbwheel arrangement featuring a thumbwheel extension element rotatably connected to and positioned, in part, within a housing element and in part extending and connecting to the traditional truss rod adjustment arrangement.

The Headpiece Tuner features a housing element or base element that includes individual string passageways extending from openings adjacent the nut through to the interior recess of the housing element. Individual associated internal string clamps elements are provided, a removable nut for separating and maintaining the strings over the fingerboard.

The individual clamping mechanisms in 4*a* includes a separate pivoting clamping lever in the interior for clamping each associated string individually within the string passageway and a setscrew threadedly connected to the housing. The setscrew, is operable to position the pivoting lever clamp in a first, unlocked position for allowing the string to slide through the string passageway and a second, clamped position to secure the string between the surface of the pivoting lever clamp and the housing element for securing the associated string to the Headpiece Tuner.

The clamping lever of 4*b* above comprises an open or unlocked position and a closed or locked position where the pivoting lever extends beyond the recess of the housing element. The clamping lever in an open or unlocked position reveals an associated recess in the housing into which an associated string can be placed. The clamping lever comprises a first string contact surface, a first string cutting surface and a pivot slot, a cross-pin variably supports the lever clamp within the pivot slot, all transverse the direction of the strings, and a set screw to define the pivot slot. A cam lobe on the lever with a setscrew could also be used [not shown]. The housing provides a corresponding associated second contact surface and second cutting surface formed in the recess. Pivoting the lever to a closed position will both clamp and cut the associated string. A pre-cut string could also be clamped in this manner.

Another feature of the Headless Tuner allows for flexibility in stringing the instrument. For example, two methods of installing and clamping:

1) Install the Plain End the String Over the Nut and into the Interior of the Housing:

The ball-end secured at the body, cut the plain end of the string a length approx 1 inch beyond the nut, insert from the direction of the body and thread the associated setscrew to clamp, the approximate 1 inch length to ensure the cut ends do not extend beyond the housing, thereby, eliminating exposed sharp cut ends.

2) Install the Ball-End or Like of the String from within the Interior of the Housing and Over the Nut:

From within the Headpiece Tuner housing, insert the plain end through the string passageway, up and over the nut, in a direction extending to the body, until the ball-end, or the like, rests within the interior recess of the housing, the string optionally clamped and then the plain end cut, secured and pitch tuned at the body.

Typically, the thumbwheel extension includes a connecting portion, for example, extending towards the body through the housing recess comprising a hex-portion to replace or mechanically couple to the truss rod or its adjustment cap or nut. Accordingly, turning the thumbwheel adjusts the truss rod tension to adjust relief achieving the truss rod's "initial position" established at the time of the instrument's initial setup. The connecting portion can be retractable to, at least, avoid unwanted mechanical rattles, vibrations, etc.

As is well known to those in the art, adjusting the truss rod can take more torque than expected at times. The Headpiece Tuner can have one or more inter-cooperative parts including a multi-function lever aspect; the radial distance from the thumbwheel's rotational centerline axis is increased by the lever compared to the knob alone, making adjustment finer and easier—in one embodiment, two designs are presented: 1) a pop-out handle element fashioned within the thumbwheel knob and 2) a removable lever-pin element, say 0.250 in diameter, inserted into a cross-bore formed in the knob, transverse to the axis of rotation, to facilitate adjustment as discussed—the removable lever-pin element can be stored, in part or in whole, in a port fashioned in the housing element, further the removable lever-pin element can extend outwardly form the housing, or fashioned, further still, into a shape, say 3.5" wide, for hanging the headless guitar on stands built for a head or head shape as found on traditional guitars. Accordingly, when the environmental conditions or playing requirements change, and the truss rod needs attention, the player can pull the removable lever-pin element out of the housing element and insert into the thumbwheel cross-bore to easily adjust the relief on-the-fly without traditional tools.

Magnetic Stabilizers

The Magnetic Stabilizer is directed to creating or enforcing initial position for a floating tremolo. Each Magnetic Stabilizer includes magnetic elements in a combination of 1) at least one iron-based element and at least one magnetic element or 2) at least two magnetic elements, arranged in variable proximity to each other, operable to variably repel or attract, to form a variable pre-loaded force of tension. The variable pre-loaded force of tension operable to 1) exert a first magnetic force of tension to comprise the biasing element or 2) exert a second magnetic force of tension to enforce initial position otherwise established by the tremolo springs. In either application, installation options include 1) one of two magnetic elements positioned on the body, in the tremolo pocket, for example, and the other on the fulcrum tremolo, or 2) both magnetic elements are positioned on the fulcrum tremolo and moveable therewith. The body can comprise a support plate to hold a magnetic element, for example.

The Magnetic Stabilizer device includes an arrangement to variably adjust the proximity of each of the two magnetic elements and thereby adjust the variable force that otherwise comprises either the first magnetic force of tension as a biasing element or the second magnetic force of tension. An adjustment member or a thumbwheel element includes a holder element, including an extended portion, separate from the spring block base element, operable to be adjusted towards the tremolo pocket face and away from the base element. Further, the holder element comprising at least one Magnetic Stabilizer arrangement comprises at least one contact pin adjustably secured to the magnetic elements, for fitment in the tremolo pocket, threading the thumbwheel adjustment mechanism is operable to adjust or establish initial contact of the contact pins at initial position.

Stabilizer Tuners

In a preferred embodiment, a Magnetic Stabilizer Tuner is presented comprising an independently adjustable pre-loaded magnetic arrangement. Each Magnetic Stabilizer Tuner comprising an individual Tensioner Housing adjustably secured to recesses or ports in the main block, or preferably, the secondary spring holder extended portion. The housing being generally cylindrical, a first magnetic element within, at a first end, a support collar or guide element variably positioning a second magnetic element at a second end and an adjustment pin or extension element threadely connected to the collar within the cylindrical housing extending through formed openings in the extended portion of the secondary spring holder, operable to variably extend the adjustment pin to the tremolo pocket. The adjustment pin comprises a rounded tip often and sometimes comprises a ball bearing element.

The first magnetic element and the second magnetic element are variably positioned in proximity to repel each other. Threading the Tensioner Housing in the secondary spring holder element is operable to vary the proximity of the first magnetic element relative to the second magnetic element to provide an adjustable force of approximately 2~15 pounds. A player can adjust the pre-loaded condition of the magnetic arrangement by rotating the Tensioner. Accordingly, the apparatus comprises a limited discontinuous force operable to increase the force required to pivot the fulcrum tremolo rearwardly from initial position. Since the adjustment of the forces of the internal magnetic arrangement is independent of the adjustment of the forces of the biasing element, the thumbwheel is free to be operable to re-establish initial position on the fly without altering the integrity of the finely adjusted pre-tensioned forces of the spring arrangement.

Another embodiment of the Magnetic Stabilizer comprising primarily an adjustment member or, alternately, a thumbwheel, threadedly connected through the spring block of a fulcrum tremolo, and moveable therewith around the tremolo pivot axis, the adjustment member extending in the direction of the strings. The adjustment member comprising a first magnetic element, connected to the spring block, is operable to adjust proximity to a second magnetic element secured within the tremolo pocket to variably enforce initial position.

In yet another embodiment the internal pre-loaded magnetic arrangement can be modified to provide the first variable force of tension in order to obviate the traditional tremolo springs and spring claw arrangement.

"Initial position" refers to the preferred adjusted position for each element of the "initial setup"—this can include, intonation, neck "relief" or truss rod adjustment, string height relative to the body and the neck, tremolo springs, etc. Accordingly, for the initial position of relief and, therefore, the position of the truss rod is determined by a balance between the force of string tension and the force of tension created by the adjusted truss rod. Further, the initial position of the fulcrum tremolo and, therefore, the position of the second critical point on the bridge elements in relation to the first critical point on the nut such that the tension of the strings, each at the intended proper pitched condition, the spring block, and the appropriately tensioned counter springs, renders a specific equilibrium point wherein the harmonic tuning for all the strings is simultaneously achieved.

"Headless Tuner" or "Headpiece Tuner" refers to an adjustment device added to a string musical instrument at the end of the neck to connected to the truss rod mechanism to adjust the force of tension created by the truss rod to establish the balance point of neck relief for initial position. Further the device can clamp or lock the strings at or around the nut. The Headpiece Tuner preferably employs an adjustment knob or thumbwheel element for providing continuously variable adjustment of the tension in the truss rod. The thumbwheel adjustment knob can further fashioned with a lever-like element to increase the turning radius of the thumbwheel to increase the tuning resolution and ease of use.

"Global Tuner" refers to an adjustment device added to a fulcrum tremolo and its associated counter spring or biasing element arrangement with the capacity to essentially re-establish the equilibrium point, created at the time of the initial setup by the tension of the counter spring(s) and the tension of the strings, in order to compensate for changes in tension requirements on the strings and/or the counter springs due to various factors. The Global Tuner preferably employs an adjustment knob or thumbwheel element for providing continuously variable adjustment of the tension in the strings by varying the relative distance between the spring attachment portion connected to the fulcrum tremolo and the attachment point of the springs to the body of the instrument. The Global Tuner thumbwheel portion provides a simple and quick means for the musician to adjust the initial position of the fulcrum tremolo in order to meet the pitch requirements in varied environmental or other situations and, in re-establishing the initial position, allows the full range of pivoting the fulcrum tremolo.

"Initial contact" refers to instance of an adjustment when a tuning mechanism first touches the instrument body, the tuning mechanism operable to affect initial position in a fulcrum tremolo.

A "hard" stop provides initial contact operable to impede rotation of the fulcrum tremolo in one direction at initial position; the "over-tightening" of the biasing element requirement to reinforce initial position obviates a global tuner.

"Tremolo Stop Tuner" refers to device integrated into a fulcrum tremolo spring block, moveable therewith about the tremolo pivot axis, comprising a holder element comprising an extended portion operable to either variably contact the body with the capacity to stop or block the tremolo at initial position, adjustably support a compression spring element to enforce initial position or global tune an independent stabilizer arrangement enforcing initial position.

A "soft" stop provides initial contact operable to affect a limited discontinuous force curve exerted on the tremolo spring block to adjustably impede rotation of the fulcrum tremolo in one direction at initial position. The adjustability obviates a stop mechanism.

"Initial condition" refers to the instance of an adjustment of the force operable at initial contact to complement the force of the biasing element when at initial position for a "soft" stop.

A "Tremolo Stabilizer" refers to a formed spring element arrangement added to the fulcrum tremolo, to make initial contact with the body with sufficient force of tension to limit the essentially linear performance of the biasing element force of tension in order to enforce initial position. Accordingly, when a force is exerted to move the tremolo out of initial position, the tremolo is subject to a restoring variable second force of tension that is borne and defined by the pre-tension stored in the spring element until the restoring force is overcome during deeper rotation or pivoting of the tremolo or disengaged at or near initial position.

Given sufficient focus of the discontinuous force at initial position to impede rearward tilt, the soft stop arrangement can be combined with an auxiliary quick pitch change apparatus, like the D-tuna, the Drop Tuner—McCabe U.S. patent application Ser. No. 14/880,271 ("'271") or any device with the capacity to quickly change from one adjustable predetermined pitch to another adjustable predetermined pitch and back to ensure the tremolo remains at initial position when the higher tensioned string is toggled to a lower tensioned condition.

Also shown is a dual loading/locking macro-tuner mechanism comprising an articulated extended tip of extended laver-clamp improvement to facilitate threading a string through the nose slot to pivot or lift the clamp lever for successful loading of the string from a direction opposite or distinct from the traditional direction of operation carried out from the direction the tailpiece portion securing the string to the instrument.

Figure 3:
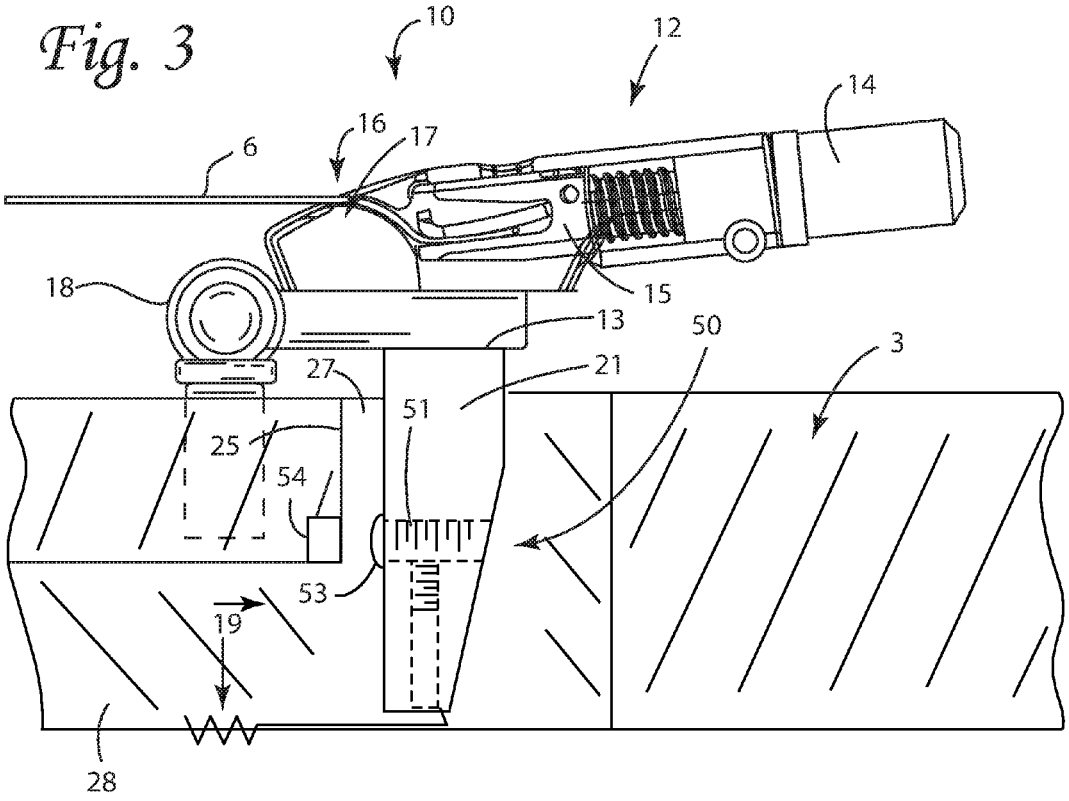

FIG. 3 is a side view of the tremolo showing a simple Magnetic Stabilizer embodiment. A first magnetic element is installed in the face of the tremolo pocket wherein a magnetic adjustment member, comprising a second magnetic element, threadedly connected to the base element, is in variable proximity to the first magnetic element in tremolo pocket, operable to exert a variable limited force operable at initial contact to enforce initial position. The second force of tension created by the opposing magnets repelling each other complements the first force of tension comprising the biasing element to create a variable "soft" stop or stabilizer. Threading the adjustment element or thumbwheel in this setup is operable to variably adjust the rate of the force of the pre-load in the context of the configuration's interdependence with force of the biasing element at initial position.

Figure 4:
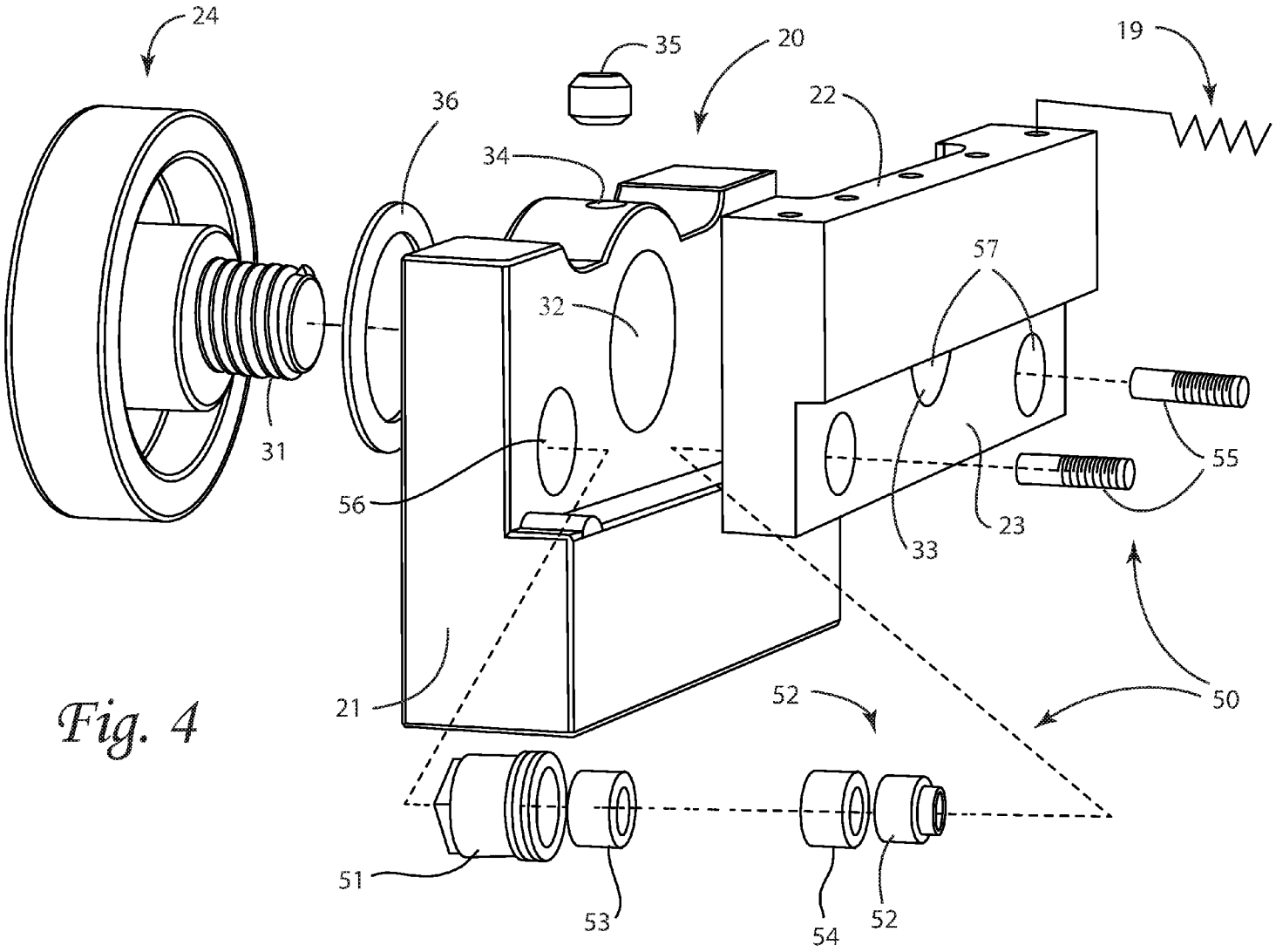
Figure 5:
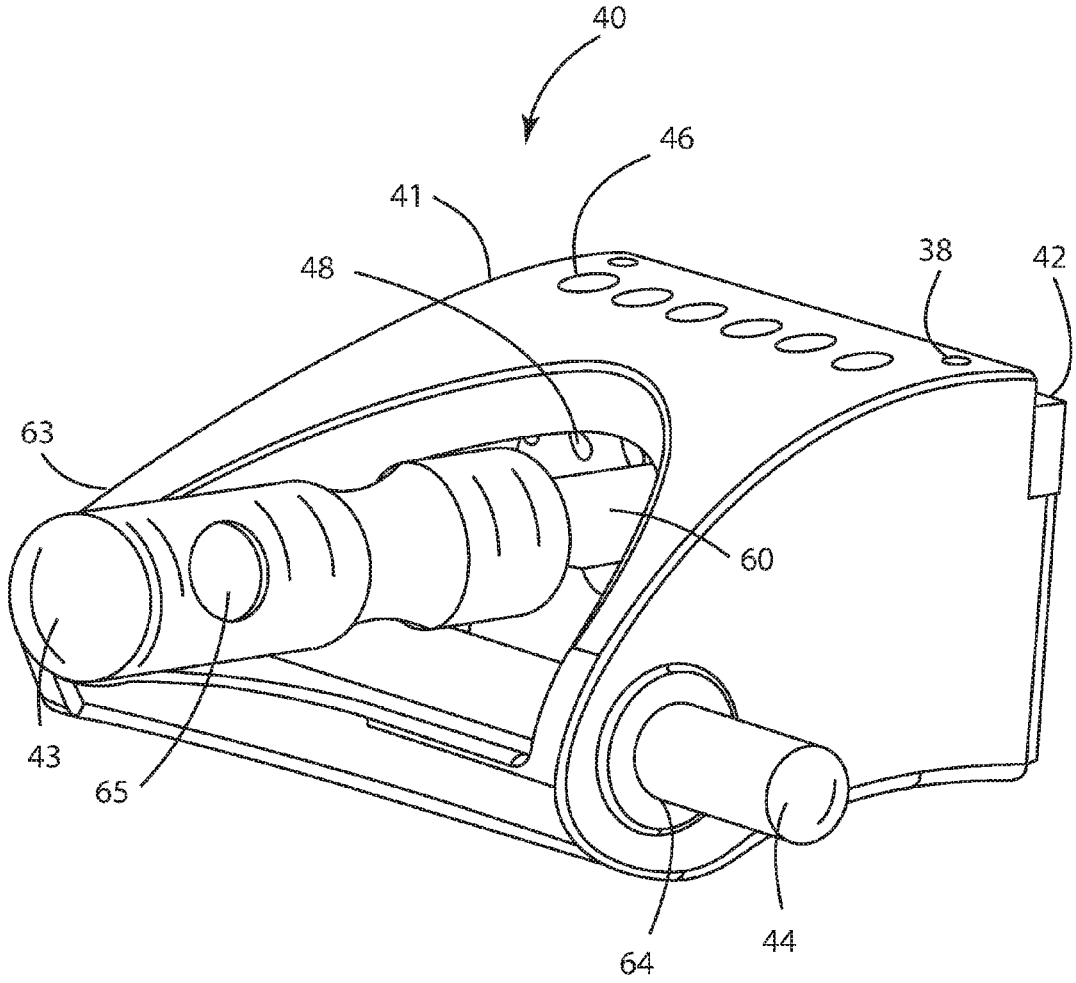

FIG. 4 shows a fully independent adjustable Magnetic Stabilizer, repurposing the Global Tuner thumbwheel arrangement with the extended portion to variably support and position a dual Magnetic Stabilizers that include a guide element, a fine adjustment element or extension element, a pre-loaded magnetic arrangement, the magnetic tensioner element is threadedly connected to the extended portion, positioned additionally within cooperating cavities in the main spring block. The tensioner element formed to receive a first magnetic element and guide element, a second spring positioned between the guide element and the first magnetic element, threading the tensioner element adjusts the force of tension created by the repulsion energy, twin mechanisms are used, one on each side of the center mounted thumbwheel adjustment element operable to variably enforce initial position. The fine adjustment element is theadedly secured within the guide element and operable to adjust the tip in dimensions up to more than 0.250 from the spring block to the first face for initial contact. Since threading the tensioner element is independently operable to variably adjust the rate of the force of the pre-load, this configuration benefits from the increased stability and improved acoustic coupling and frees the thumbwheel element to global tune the stabilized initial position over time. The dual Stabilizers are collectively capable of exerting a combined force of at least 8 to 10 pounds to variably ensure initial position FIG. 5 shows a ¾ view of the preferred embodiment of the Headpiece Tuner improvement before being installed on the end of the headless neck. The Headpiece Tuner includes a housing for a dual loading/locking feature that includes a recess within the housing for receiving the ball end of the string or short pre-cut strings, a removable nut, adjustment port for accessing height adjustment screws [not shown]. Also shown is a thumbwheel arrangement with a portion extending towards the truss rod operable to turn the truss rod, a recess in the thumbwheel to receive the removable cross-bar, the cross-bar in a length to facilitate the headless instrument hanging from traditional instrument stands when reinstalled in the housing.

Figure 6:
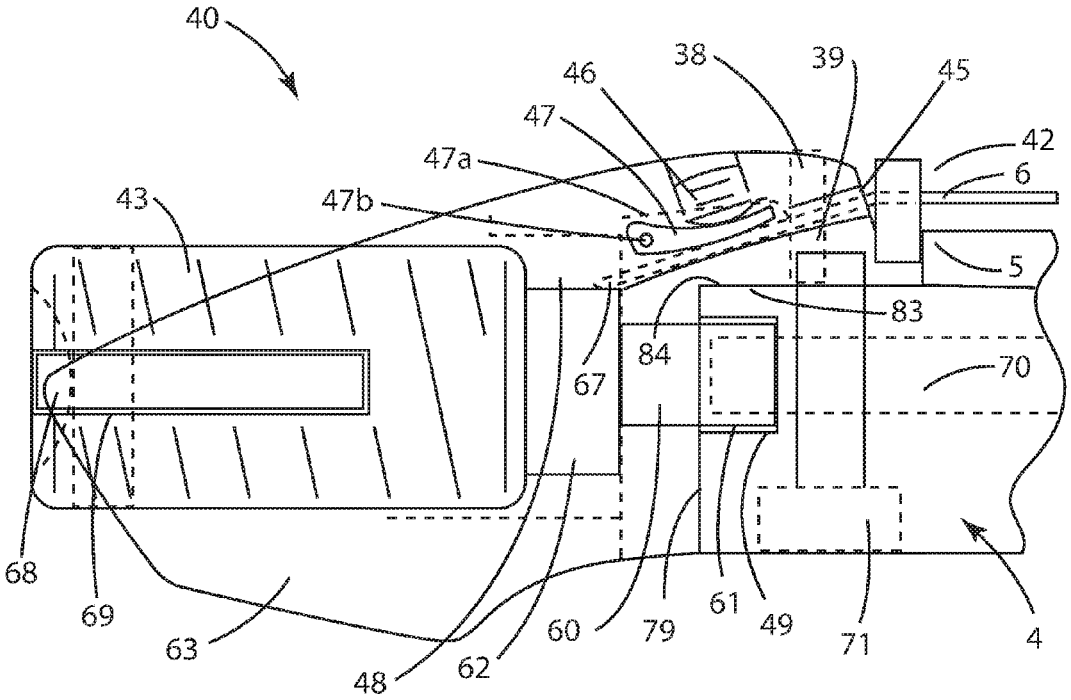

FIG. 6 shows a profile view of a second preferred embodiment of the Headpiece Tuner improvement on the end of the headless neck with fingerboard. The Headpiece Tuner housing mounting surface is threadedly secured to end of the headless neck by screws comprising a first position. Housing height adjustment setscrew are variably secured within ports, threading the setscrew adjusts first position, and, thereby, the removable nut to meet varied setup requirements. The Headpiece Tuner includes a housing for a dual loading/locking feature that includes a recess within the housing for receiving the ball end of the string or short pre-cut strings, string lever clamp, string passageways, a removable nut, adjustment port for accessing height adjustment screws. Threading the associated locking screw adjusts an individual pivoting lever to secure an associated string. Also shown is a thumbwheel arrangement with a connecting portion extending towards the truss rod including a recess or similar at the end of the connecting portion to mechanically couple with the truss rod or truss rod nut [not show], attachment screws and a retractable pivoting lever positioned within a recess formed in the Thumbwheel to facilitate turning the truss rod.

Figure 7:
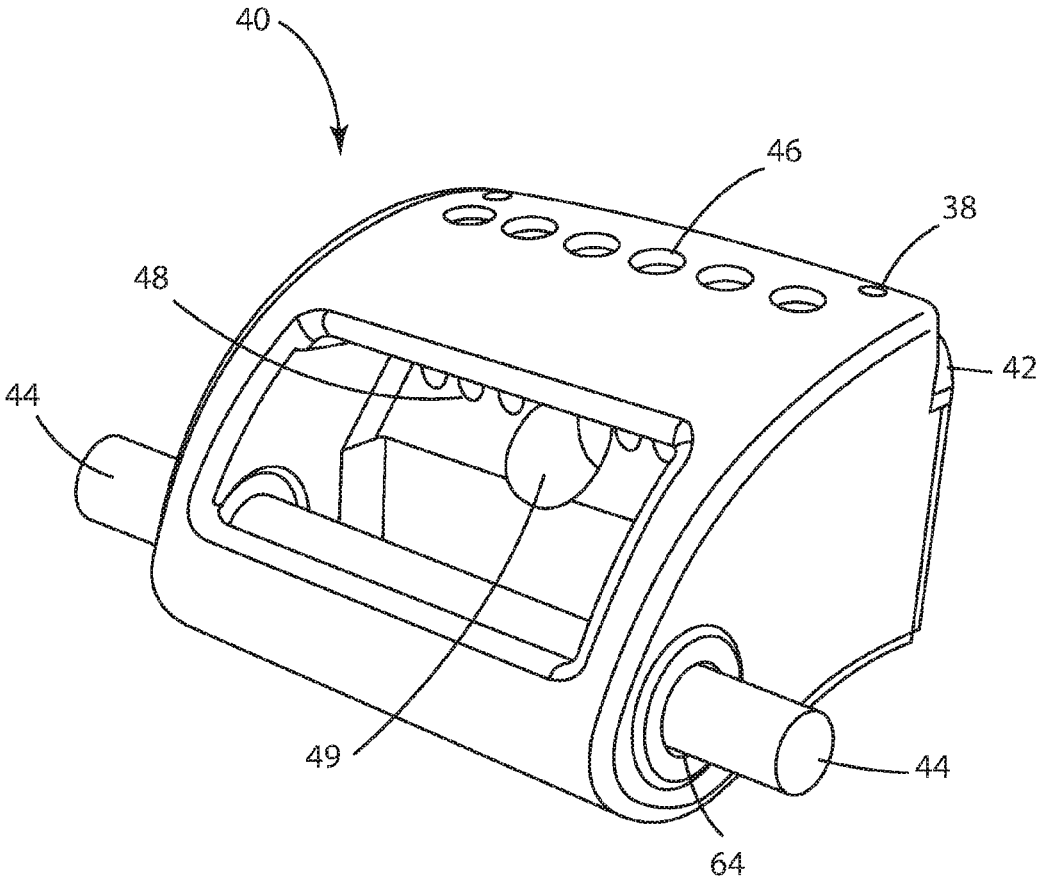

FIG. 7 shows a ¾ view of another embodiment of the Headpiece Tuner improvement before being installed on the end of the headless neck. The Headpiece Tuner includes a housing for a dual loading/locking feature as well as a recess within the housing for receiving the ball end of the string or short pre-cut strings, a removable nut, and adjustment port for accessing height adjustment screws [not shown]. A removable cross-bar is shown in a length to facilitate the headless instrument hanging from traditional instrument stands when reinstalled in the housing.

Also shown thru-bore extending towards the truss rod operable to allow a truss rood tool to access and adjust the truss rod.

Figure 8:
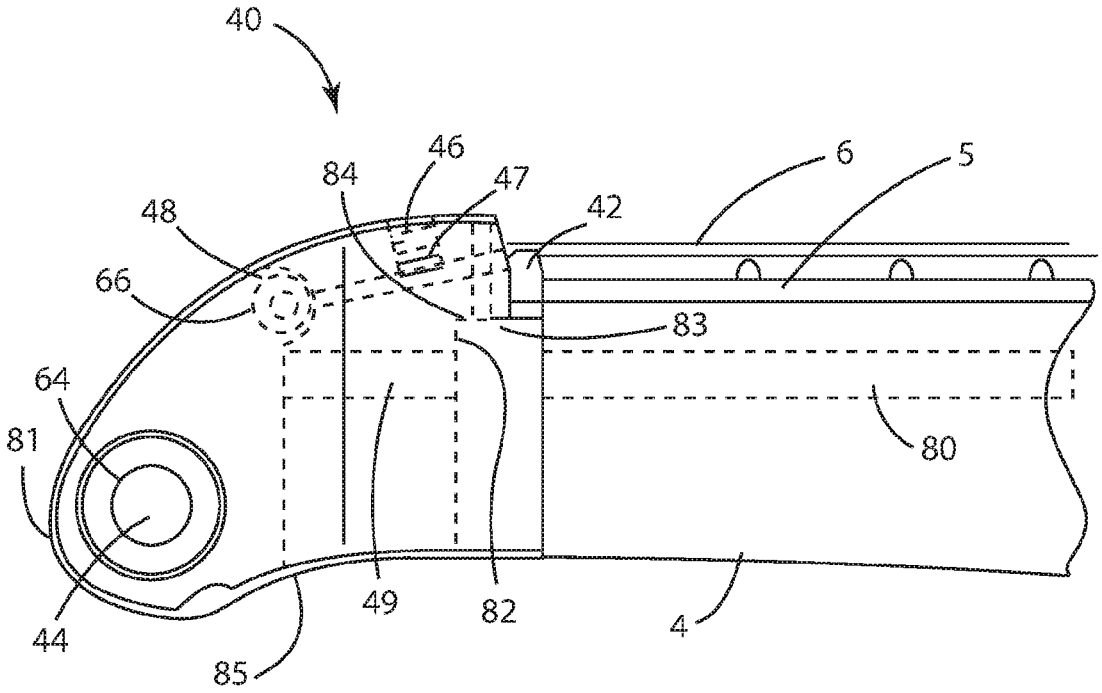

FIG. 8 also shows in profile the Headpiece Tuner attached to the end of a headless neck further comprising a fingerboard. The Headpiece Tuner housing mounting surface is threadedly secured to end of the headless neck mounting shelf by screws comprising a first position. The ball end is shown within a recess with the housing extending though string passageway under the clamping arrangement, over the removable nut and suspend over the fingerboard extending towards the body [not shown].

Figure 9:
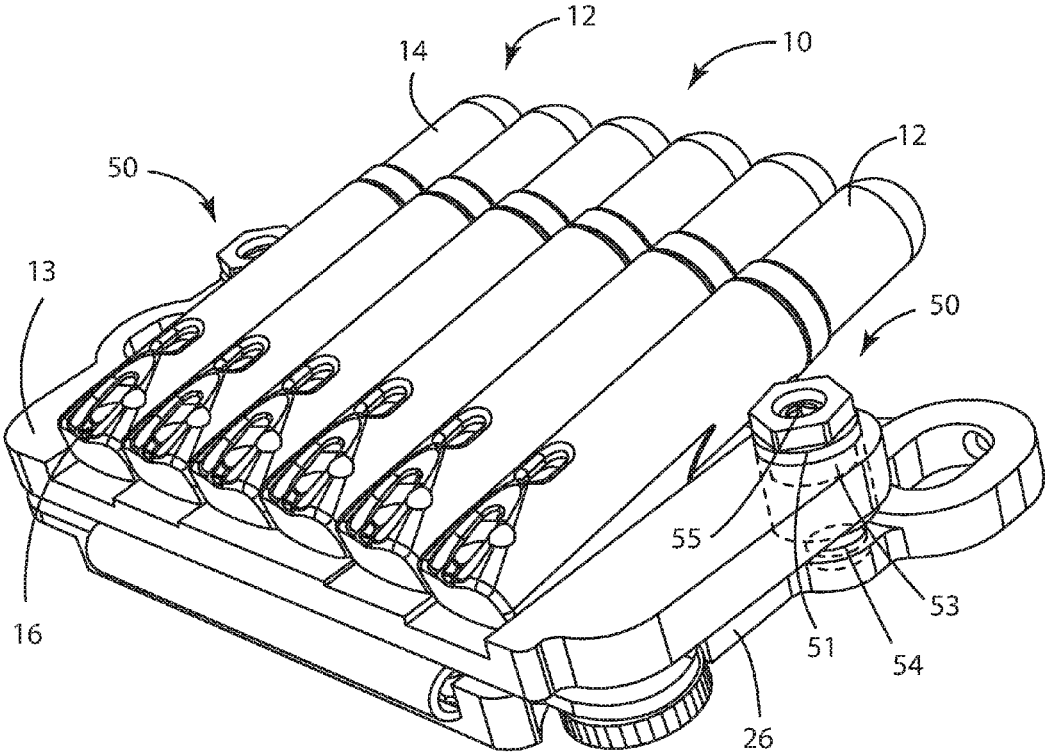

FIG. 9 shows a top mounted tremolo in ¾ view comprising macro-tuners forming second intonation point, the tremolo further comprising a magnetic stabilization apparatus arranged on the tremolo, a first magnetic element mount variably secures a first magnetic element within the adjustment housing threadedly secured to base plate; threading the adjustment housing is operable to vary proximity of the first magnetic element to a second magnetic element secured to support plate 26 [secured to the body 3 not shown] to enforce initial position.

Figure 10A:
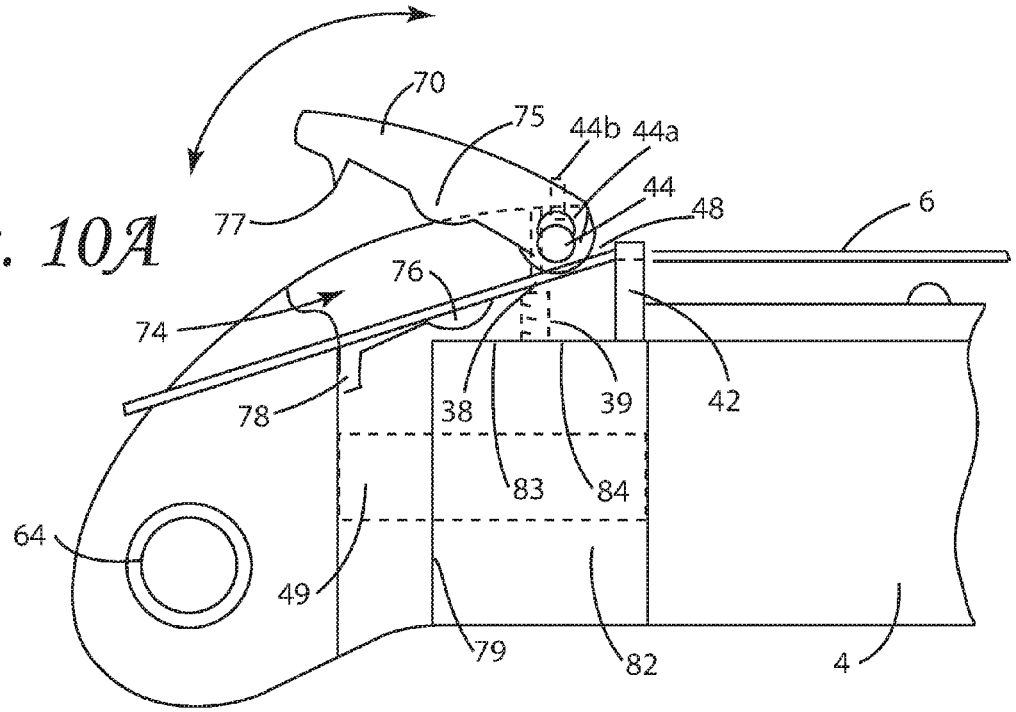

FIG. 10A is similar to FIG. 8, showing a profile view of the Headpiece Tuner, in an alternate embodiment of string clamps. The Headpiece Tuner housing mounting surface is threadedly secured to end of the neck mounting shelf by screws comprising a first position. Housing height adjustment setscrew are variably secured within ports, threading the setscrew adjusts first position, and, thereby, the removable nut to meet varied setup requirements. The string is shown extended from the body [not shown] over the end of the neck and into a recess/string passageway area. One of the pivoting multi-function string clamps is in an open or unlocked position to show both the associated contact surface of the housing formed to receive the string contact portion and the cutting surface of the housing formed to receive the string cutting portion. Pivoting the multi-function string clamp to a closed position will both clamp and cut the associated string—see FIG. 10B. Further, a setscrew in the housing is adjustable to variably contact the end of the neck. Threading the setscrew adjusts the position of the housing and nut relative to the end of the neck.

Figure 10B:
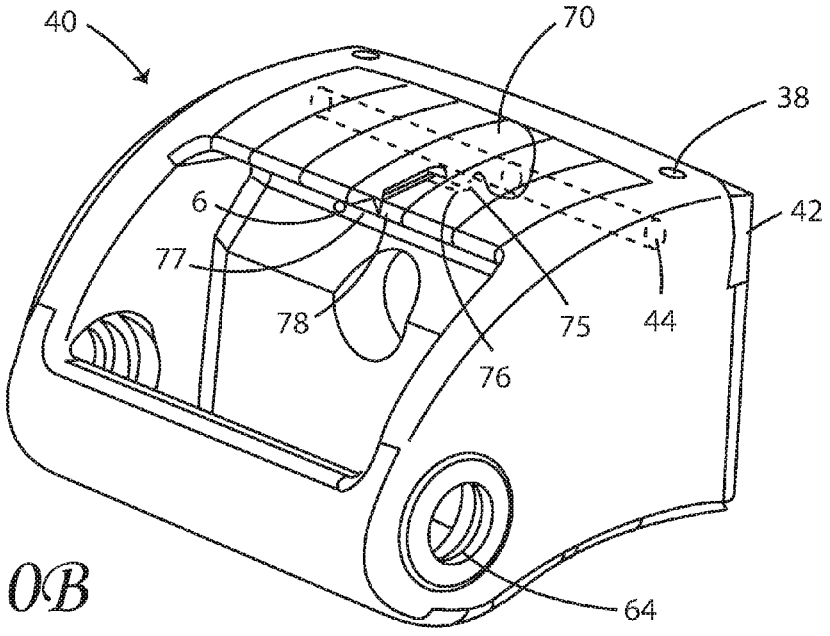

FIG. 10B is similar to FIG. 7, showing a ¾ view of the Headpiece Tuner, in an alternate embodiment of string clamps. The Headpiece Tuner housing mounting surface is threadedly secured to end of the headless neck mounting shelf by screws comprising a first position. Shown is one of the pivoting multi-function string clamps in an closed or locked position [one multi-function string clamp removed for illustration] to show the string clamped between the associated contact surface of the housing formed to receive the string contact portion and the cut end of the string after the string cutting portion is positioned in the cutting surface of the housing. A pin shown for the individual levers assembled in the housing.

DETAILED DESCRIPTION OF THE INVENTION

Figure 1:
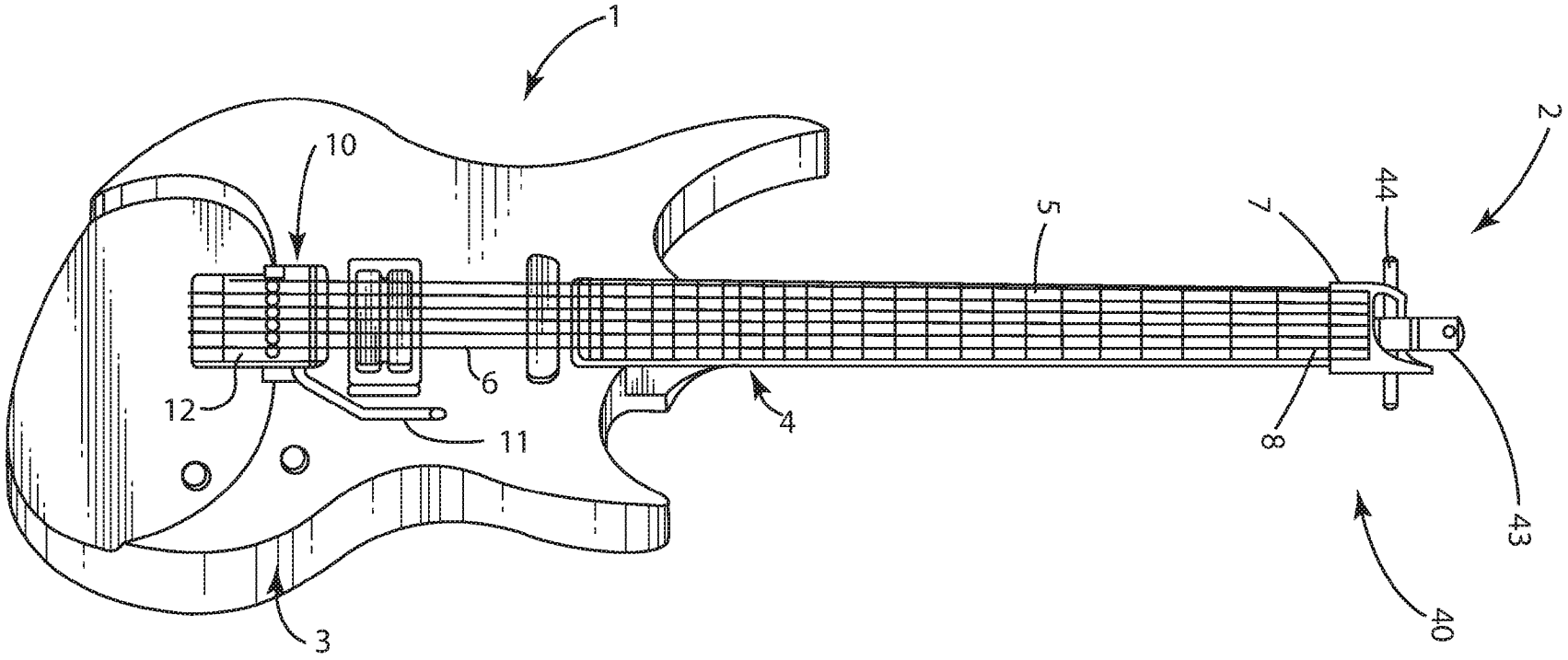
FIG. 1 is a plan view of an electric guitar embodying the present inventions.

In FIG. 1, an electric guitar 1 is illustrated comprising Headpiece Tuner 2 at one end, a body 3 at the other end, with neck 4 extending between head 2 and body 3. Six of each string 6 extends from Headpiece Tuner 2 to body 3 over neck 4. Neck 4 forms fret board or fingerboard 5 for guitar 1. At Headpiece Tuner 2, each string 6 extends over nut 7 forming first critical point 8 for each string 6 and is secured. Nut 7 is located at the transition of neck 4 to head 2. Headpiece Tuner 2 includes Truss Rod Thumbwheel 9. On body 3, strings 6 are secured to fulcrum tremolo 10. Fulcrum tremolo 10 has arm 11 for pivoting tremolo 10 to provide the vibrato effect on the strings. Fulcrum tremolo 10 has six intonation modules 12, one for each string 6. By manipulating tremolo arm 11, the entire fulcrum tremolo 10, not including the riser posts and inserts (and in varied designs, related bearing assembly elements), can be pivoted to achieve the desired tremolo effect.

Intonation module 12, shown as a macro-tuner, incorporating the function of bridge or saddle and tailpiece elements, is provided to support string 6. Intonation module 12 is slideably adjustable on base plate 13 to adjust the relative distance between first critical point 8 and second critical point 16 (FIG. 2) to intonate the associated string. Fulcrum tremolo 10 comprises a second critical point 16, one for each string 6, sometimes characterized as an intonation point, witness point or bridge point.

The invention is shown for on electric guitar 1 with six strings 6 and it should be understood that the invention could be used on a variety of stringed musical instruments. In body 3 of guitar 1 there are electric pickups shown without numbers. In the following description, fulcrum tremolo 10 will be described in greater detail.

Figure 2:
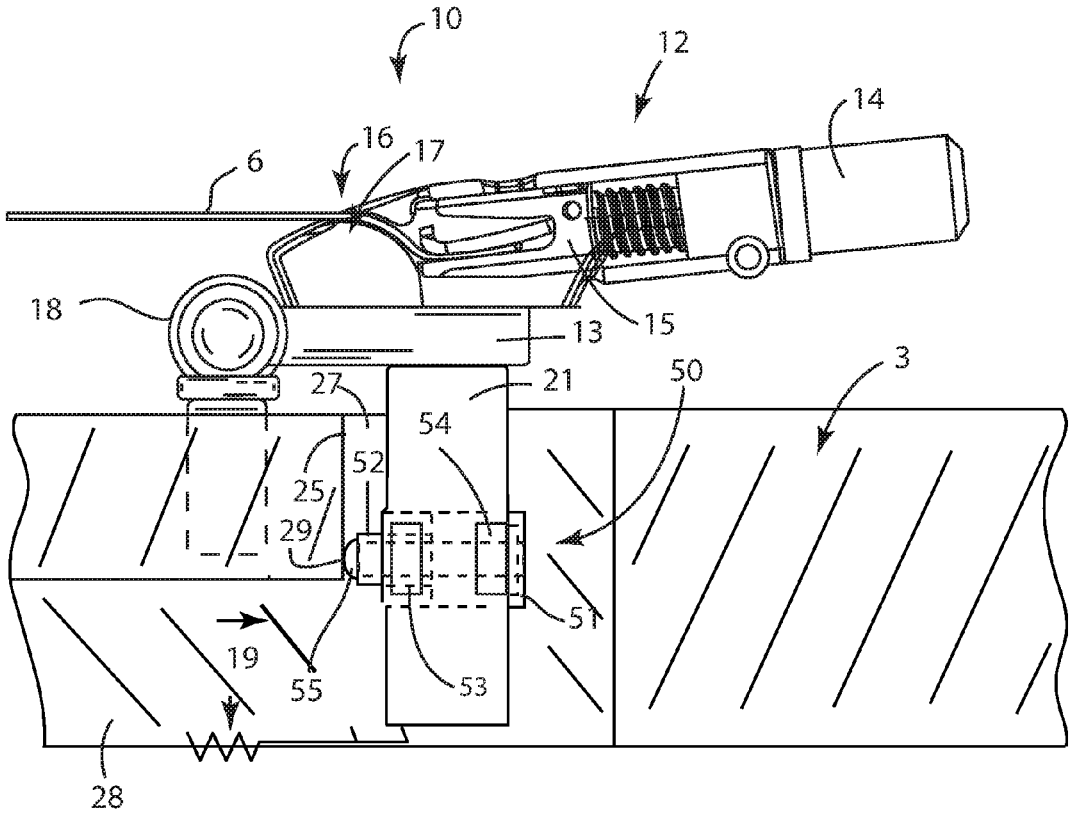
FIG. 2 is a side view of the tremolo showing the Magnetic Stabilizer mechanism positioned within the spring block descending from the base plate. Two magnets in close proximity, poles variably arranged to provide a force of repulsion, comprising a variable pre-load exerted through the contact pin against the tremolo pocket face operable at initial contact to enforce initial position. The Magnetic Stabilizer pre-load complements the biasing element to create a variable "soft" stop stabilizer. Threading the adjustment element in this setup is operable to variably adjust the proximity of the two opposing magnets on axis to adjust the rate of the force of the pre-load in the context of the configuration's interdependence with elastic force of the biasing element at initial position.

FIG. 2 displays fulcrum tremolo 10 at initial position in a partial cross-section side view showing body 3. Electric guitar 1 further comprising tremolo pocket 28 and tremolo spring pocket 29, Magnetic Stabilizer 50 and locking macro-tuner 12 comprising bridge element 17, an tailpiece comprising tuning pin 15 variably positioned by tuner knob 14 to alter the tension of string 6 secured to Headpiece Tuner 2 (not shown). Second critical point 16 is located on intonation module 12. String contact point 16 on bridge element 17. The leading-edge portion of base plate 13 adjustably supports tremolo 10 pivotally relative to body 3. Spring block 21 is connected to base plate 13.

Magnetic adjustment element 51 threadedly connected to spring block 21 including first magnetic element magnet 53, positioned within element 51 in proximity to, operable to variably repel, second magnetic element 54 urging guide 52 towards tremolo pocket face 25. Guide 52 threadedly receiving contact pin 55 extending to initial contact 29 on tremolo pocket face 25. The opposing magnetic force will exert a second variable force of tension through guide 52 and contact pin 55 against tremolo pocket face 25 operable at initial contact 29 to enforce initial position. Threading adjustment element 51 varies the proximity of the first magnetic element 53 to second magnetic element 54 to vary second variable force of tension or the pre-load held by contact pin 55 at initial position.

FIG. 3 shows fulcrum tremolo 10 at initial position in a partial cross-section side view showing body 3. Electric guitar 1 further comprising tremolo spring pocket 28 and tremolo pocket 29, Magnetic Stabilizer 50 and locking macro-tuner 12 comprising bridge element 17, an associated tailpiece comprising tuning pin 15 variably positioned by tuner knob 14 to alter the tension of string 6 secured to Headpiece Tuner 2 (not shown). Second critical point 16 is located on intonation module 12. String contact point 16 on bridge element 17. The leading-edge portion of base plate 13 adjustably supports tremolo 10 pivotally relative to body 3.

Tremolo 10 illustrates a side view including main block 21 connected to base plate 13, biasing element 19 is shown connected to main block 21. Pin 51*a* comprising first magnetic element 53 threadedly connected to main block 21. Body 3 further comprises second magnetic element 54. Threading pin 51 will vary proximity of first magnetic element 53 to second magnetic element 54, magnetic poles arranged to repel, in order to exert a second force of tension comprising a variable magnetic pre-load operable to enforce initial position without contact between the first and second magnetic elements.

FIG. 4 shows an alternate improved Magnetic Stabilizer 50, adapted to extended portion 23 of spring holder 22, further comprising threaded tensioner housing 51, guide element 52, fine adjustment element 55 threadedly connected to guide element 52 extending through first magnetic element 53 and second magnetic element 54.

Each magnetic stabilizer mechanism 50, holding a second variable force of tension collectively, at least 2~10 pounds force, the second force of tension less than the first force of tension created by a biasing element or tremolo springs, fine adjustment element 55 positioned to make initial contact with tremolo pocket contact area 29, tremolo 10 at initial position. Tremolo Stabilizer 50 magnetic pre-loaded second variable force of tension to increase the force required to pivot fulcrum tremolo 10 from initial position rearwardly.

Tremolo Stabilizer 50 adapts spring holder 22 extended portion 23 to receive tensioner housing 51. Tremolo Stabilizer 50 further comprising guide element 52, first magnetic element 53, second magnetic element 54 and fine adjustment element 55, extending through first magnetic element 53 within tensioner housing 51 and cooperating spring block 21 cavity 57. Magnetic pre-load to exert a second variable force of tension, at least 2~10 pounds force, comprises the second force of tension less than the first force of tension, pin 55 to make initial contact with tremolo pocket contact area 29 [not shown]. Tremolo Stabilizer 50 combined second variable force of tension to increase the force required to pivot fulcrum tremolo 10 from initial position rearwardly. Threading magnetic tensioner housing 51 is operable to adjust the magnetic pre-load created by the first and second magnetic elements in proximity. Threading the thumbwheel 24 is operable adjust the position of spring holder 22 and, thereby, and the collective second variable force of tension.

FIG. 5 shows a ¾ view of the preferred embodiment of Headpiece Tuner 40 improvement [before being installed on the end of the headless neck 4—not shown]. Headpiece Tuner 40 includes housing 41 including an extended side 63, dual loading/locking access ports 46 and recess 48 within housing 41 for receiving ball end 66 of string 6 or short pre-cut strings [not shown], removable nut 42, adjustment port 38 for accessing height adjustment screws [not shown]. Removable cross-bar 44 is shown positioned in housing 31 recess 64. Also shown is thumbwheel 45 arrangement with connecting portion 60, recess 65 in thumbwheel 43 to receive removable cross-bar 44, cross-bar 44 in a length to facilitate headless instrument 1 hanging from traditional instrument stands [not shown].

FIG. 6 shows a profile view of a second preferred embodiment of Headpiece Tuner 40 on end 79 of the neck 4 with fingerboard 5. Headpiece Tuner 40 housing mounting surface 84 is threadedly secured to end 79 mounting shelf 83 by screws 71 comprising a first position. Housing height adjustment setscrew 39 variably secured within ports 38, threading the setscrew adjusts first position, and, thereby, removable nut 42 to meet varied setup requirements. Headpiece Tuner 40 includes housing 41 for a dual loading/locking feature that includes recess 48 within housing 41 for receiving ball end 66 of string 6 [not shown—see FIG. 8] or short pre-cut string ends 67, string clamp screw 46, clamp lever 47, string passageway 45, removable nut 42, adjustment port 38 for accessing height adjustment screw 39. Clamping lever 47 comprising clamp surface 47*a* and clamp pivot pin 47*b*. Threading clamp screw 46 positions clamping lever 47 to secure string 6 to Headpiece Tuner 40. Also shown is a thumbwheel 43 arrangement with connecting portion 60 extending towards truss rod 70 including formed portion recess 61 or similar at the end of connecting portion 60 to mechanically couple with truss rod 70 or truss rod nut [not show] and a retractable pivoting lever 68 positioned within recess 69 formed in thumbwheel 43 to facilitate turning truss rod 70.

FIG. 7 shows a ¾ view of another embodiment of Headpiece Tuner 40 improvement before being installed on the end of the neck. Headpiece Tuner 40 includes housing 41 for a dual loading/locking feature 46 as well as recess 48 within housing 41 for receiving ball end 66 of the string 6 or a short pre-cut string 67 [not shown], removable nut 42, and adjustment port 38 for accessing height adjustment screws 39 [not shown]. Removable cross-bar 44 is shown in a length to facilitate headless instrument 1 hanging from traditional instrument stands [not shown]. Also shown thrubore 49 extending towards truss rod 70 [not shown] operable to allow a truss rood tool to access and adjust truss rod 70.

FIG. 8 also shows in profile Headpiece Tuner 40 connecting end 82 attached to neck 4 further comprising a fingerboard 5. Headpiece Tuner 40 housing mounting surface 84 is threadedly secured to mounting shelf 83, opposite plain side 85 by screws [not shown] comprising a first position. Ball end 66 of strings 6 are shown within recess 48 extending though string passageway 45 under the clamping arrangement 46 and 47, over removable nut 42 and string 6 suspended over the fingerboard 5 extending towards body 3 [not shown]. Cross-bar 44 is shown held in recess 64 of housing 41.

FIG. 9 shows a top mounted tremolo 10 in ¾ view comprising macro-tuners 12 forming second intonation point 16, tremolo 10 comprising a magnetic stabilization apparatus 50 on the tremolo base plate 13, first magnetic element mount 55 variably secures first magnetic element 53 within adjustment housing 51 operable to vary proximity to second magnetic element 54 secured to support plate 26 [connected to the body 3 not shown] to enforce initial position.

FIG. 10 A is similar to FIG. 8, showing a profile view of Headpiece Tuner 40 with alternate embodiment of multi-function string clamp 70. Headpiece Tuner 40 housing mounting surface 84 is threadedly secured to end 82 mounting shelf 83 by screws 81 comprising a first position. Housing height adjustment setscrew 39 variably secured within ports 38, threading the setscrew adjusts first position, and, thereby, removable nut 45 to meet varied setup requirements. String 6 is shown extended from body 3 [not shown]

over end of the neck 4 and into a recess/string passageway area 74. Pivoting multi-function string clamp 70 is shown in an open or unlocked position to reveal both associated contact surface 76 of housing 40 formed to receive string contact portion 75 and cutting surface 78 formed to cooperate with string cutting portion 77 to cut associated string 6. Multi-function string clamp 70 is further formed with slot 44*a* that allows lever 70 to variably pivot on support cross-pin 44 and adjust for various gages of string thicknesses, etc. A corresponding setscrew 44*b* limits the variability to ensure the associated clamp secures the associated string in various dimensions when pivoting multi-function string clamp 70 is pivoted into a closed position to both clamp and cut associated string 6—see FIG. 10B. Further, setscrew 39 in housing 40 is adjustable to variably position the connecting end of the housing relative to the end of the neck 4. Threading setscrew 39 adjusts the position of housing 40 and nut 42 relative to the end of the neck 4. Typically the housing mounting screws that extend through the neck are loosened prior to the adjustment and subsequently retightened.

FIG. 10 B is similar to FIG. 7, showing a ¾ view of the Headpiece Tuner 40, in an alternate embodiment of string clamp 70. Headpiece Tuner 40 housing mounting surface 84 is threadedly secured to end 82 mounting shelf 83 by screws 81 comprising a first position. Pivoting multi-function string clamp 70 shown in both a closed or locked position [one multi-function string clamp 70 removed for illustration] and the remaining individual pivoting multi-function string clamp 70 to show string 6 clamped between associated contact surface 76 and string contact portion 75 and the end of string 6 cut after string cutting portion 77 is positioned into cutting surface 78. Pin 44 pivotally supports individual levers 70 assembled in housing 40.

The various features of novelty, which characterize the invention, are intended to improve the upward spiral of Light and are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

While specific embodiments of the invention have been shown and described in detail to illustrate the application of the inventive principles, it will be understood that the invention may be embodied otherwise without departing from such principles.

I claim:

1. A tremolo for a stringed musical instrument, the stringed musical instrument comprising a body, the body further comprising a top surface and a back surface, the top surface generally parallel to the back surface, a neck extending outwardly from the body, a plurality of strings extending in a direction from the body to the neck, the top surface and the back surfaces extending in the direction of the strings, the neck further comprising an end, a nut positioned at the end of the neck to form a first critical point for each of the strings, the end of the neck operable to variably secure each of the plurality of strings on the opposite side of the first critical point from the body, a bridge element, the bridge element further comprising individual bridge elements, an individual bridge element associated to each of the plurality of strings, the individual bridge element forming a second critical point for supporting each associated string, the individual bridge element adjustably secured to the body for intonating the associated string, each of the plurality of strings intonated collectively comprising harmonic tuning, a tailpiece element, the tailpiece element further securing the plurality of strings to the body, each of the plurality of strings operable to be tensioned to pitch for play, strings tensioned for play comprises string force of tension, strings tensioned for play comprising harmonic tuning, a tremolo, the tremolo pivotally mounted on the body for pivotally supporting the plurality of strings, the tremolo comprising a tremolo pivot axis, the tremolo operable to be pivoted rearward to increase tension and pitch of each of the plurality of strings, and forward to decrease tension and pitch of each of the plurality of strings, the tremolo further comprising an apparatus, the apparatus secured to the tremolo, the tremolo comprising:

a base plate comprising:
- a first side furthest the body,
- a second side closer the body, at least one threaded element, the at least one threaded element connected to the tremolo, a magnetic biasing apparatus, the magnetic biasing apparatus comprising:
- a first magnetic element, the first magnetic element formed to secure to the body, the first magnetic element comprising a first magnetic pole,
- a second magnetic element, the at least one threaded element to variably secure the second magnetic element to the tremolo, the second magnetic element comprising a second magnetic pole,
- the first magnetic pole aligned to the second magnetic pole,
- the first magnetic element and a second magnetic element in variable proximity, the first magnetic element and the second magnetic element in variable proximity exerting a variable elastic force, the variable elastic force comprising a first force of tension, the first force of tension to counter balance string force of tension, wherein strings tensioned for play, the first magnetic element, in variable proximity to the second magnetic element, obtains the first variable force of tension to bias string force of tension at initial position.

2. Apparatus of claim 1 wherein the tremolo further comprising a fulcrum tremolo, the fulcrum tremolo further comprising a spring block, the spring block further comprising a first opening, the spring block secured to, and moveable therewith, the second side of the fulcrum tremolo base plate, the body further comprising a cavity formed to receive the fulcrum tremolo, the cavity further comprising a tremolo pocket, the tremolo pocket extending from the top surface to the back surface, the tremolo pocket comprising at least one face, the at least one face generally perpendicular to the top surface of the body, the spring block having a first face generally perpendicular to the top surface of the body, the tremolo pocket to allow the spring block to pivot freely, the fulcrum tremolo operable to pivot freely within the cavity, wherein the first magnetic element secured to the body, the second magnetic element is adjustably secured to the spring block first opening to adjust proximity to the first magnetic element, adjusting proximity is operable to obtain the first variable force of tension to bias string force of tension at initial position.

3. Apparatus of claim 1 wherein the tremolo further comprises a top mounted tremolo, the top mounted tremolo further comprising a support plate, the support plate further comprising at least one recess, the at least one recess operable to receive at least one mounting screw to adjustably secure the support plate to the body, the support plate to pivotally support the base plate, the first magnetic element secured to the mounting plate, the second magnetic element variably secured to the tremolo base plate second side to adjust proximity to the first magnetic element, adjusting proximity is operable to establish initial position.

4. An apparatus for a stringed musical instrument, the stringed musical instrument comprising a body, the body further comprising a top surface and a back surface, the top surface generally parallel to the back surface, a neck extending outwardly from the body, a plurality of strings extending in a direction from the body to the neck, the top surface and the back surfaces extending in the direction of the strings, the neck further comprising an end, a nut positioned at the end of the neck to form a first critical point for each of the strings, the end of the neck operable to variably secure each of the plurality of strings on the opposite side of the first critical point from the body, a bridge element, the bridge element further comprising individual bridge elements, an individual bridge element associated to each of the plurality of strings, the individual bridge element forming a second critical point for supporting each associated string, the individual bridge element adjustably secured to the body for intonating the associated string, each of the plurality of strings intonated collectively comprising harmonic tuning, a tailpiece element, the tailpiece element further securing the plurality of strings to the body, each associated string of the plurality of strings operable to be tensioned to pitch for play, strings tensioned for play comprises string force of tension, strings tensioned for play comprising harmonic tuning, a tremolo, the tremolo pivotally mounted on the body for pivotally supporting the plurality of strings, the tremolo comprising a tremolo pivot axis, the tremolo operable to be pivoted rearward to increase tension and pitch of each of the plurality of strings, and forward to decrease tension and pitch of each of the plurality of strings, the tremolo further comprising an apparatus, the apparatus secured to the tremolo, the fulcrum tremolo comprising:

a base plate comprising:
- a first side furthest the body,
- a second side closer the body, at least one threaded element, the at least one threaded element connected to the tremolo, a biasing element, the biasing element comprising a first end and a second end, the first end connected to the fulcrum tremolo and the second end connected to the body, the biasing element tensioned to counter string force of tension comprising a first force of tension, a magnetic stabilizer device, the magnetic stabilizer device comprising:
- a first magnetic element, the first magnetic element formed to secure to the body, the first magnetic element comprising a first magnetic pole,
- a second magnetic element, the second magnetic element comprising a second magnetic pole, the at least one threaded element to variably secure the second magnetic element to the tremolo,
- the first magnetic pole aligned to the second magnetic pole,
- the first magnetic element and a second magnetic element in variable proximity, the first magnetic element and the second magnetic element in variable proximity exerting a variable elastic force, the variable elastic force comprising a first force of tension, the second variable force of tension less than the first variable force of tension, strings tensioned for play, the biasing element operable to variably support the pivoting of tremolo at initial position, wherein:

either the first magnetic element secured to the body and the second magnetic element is adjustably secured to the tremolo, or the first magnetic element and the second magnetic element are adjustably secured to the tremolo.

5. The apparatus of claim 4 further comprising a fulcrum tremolo, the fulcrum tremolo further comprising a spring block, the spring block comprising a first opening, the spring block secured to, and moveable therewith, the fulcrum tremolo base plate, the body further comprising a cavity formed to receive the fulcrum tremolo, the cavity further comprising a tremolo pocket, the tremolo pocket extending from the top surface to the back surface, the tremolo pocket comprising at least one face, the at least one face generally perpendicular to the top surface of the body, the tremolo pocket to allow the spring block to pivot freely, the fulcrum tremolo operable to pivot freely within the body cavity, wherein the first magnetic element secured to the body, the second magnetic element variably secured to the spring block first opening, adjusting proximity to the first magnetic element is operable to adjust the second variable force of tension to enforce initial position.

6. The apparatus of claim 4 wherein the tremolo further comprises a top mounted tremolo, the body further comprising a support plate, the support plate further comprising at least one recess, the at least one recess operable to receive at least one mounting screw attachment screw to adjustably mount the support plate to the body, the support plate to pivotally support the base plate, the first magnetic element secured to the mounting plate, the second magnetic element variably secured the tremolo base plate second side to adjust proximity to the first magnetic element, adjusting proximity is operable to enforce initial position.

7. Apparatus of claim 5 wherein:

the spring block first opening further comprising a threaded opening, the spring block further comprising a base element, the base element generally perpendicular to the base plate second side, the base element comprising:
- a connecting end, the connecting end closest the base plate,
- a supporting end, the support end furthest the base plate,
- a housing element, the housing element threadedly connected to the spring block threaded opening, the housing element formed to receive the second magnetic element, threading the housing element is operable vary position of the second element relative to the at least one face and, thereby, proximity to the first magnetic element, to pre-load and adjust the second force of tension.

8. Apparatus of claim 7 wherein the spring block further comprises the first magnetic element, the housing element further comprising:
- a guide element, the guide element to variably support the first magnetic element,
- an adjustable contact pin element, the adjustable contact pin element threadely connected to the guide element, the adjustable contact pin element further comprising a tip, threading the adjustable contact pin element operable to position the tip relative to the spring block, wherein the adjustable contact pin element operable to make initial contact with the tremolo pocket contact area at initial position.

9. Apparatus of claim 6 wherein:

the base plate further comprising a threaded opening, a housing element, the housing element threadedly connected to the base plate threaded opening, the housing element formed to adjustably receive the second magnetic element, threading the housing element is operable vary proximity to the first magnetic element secured to the mounting plate to pre-load and adjust the second force of tension.

10. Apparatus of claim 7 wherein:

the spring block further comprising a holder element, the holder element comprising a threaded opening, the threaded opening aligned to the first opening, the holder element transverse the direction of the strings, the holder element variably connected to the supporting end and the first end, the holder element further comprising:

a biasing end, the biasing end further the base plate, the biasing end formed to receive the first end of the biasing element, and an extended portion, the extended portion transverse the direction of the strings extending from the biasing end in the direction of the second side, the extended portion operable, at least the second magnetic element, a thumbwheel element threadedly connected to the holder element threaded opening, the thumbwheel element connected to first opening, the thumbwheel element operable to position the extended portion relative to the spring block in the direction of the tremolo pocket contact area, wherein the thumbwheel element adjusts the first force of tension.

11. A headpiece apparatus for a stringed musical instrument, the stringed musical instrument comprising a body, the body further comprising a top surface and a back surface, the top surface generally parallel to the back surface, a neck extending outwardly from the body, a plurality of strings extending in a direction from the body to the neck, the top surface and the back surfaces extending in the direction of the strings, the neck further comprising an end, a nut positioned at the end of the neck to form a first critical point for each of the strings, the end of the neck operable to variably secure each of the plurality of strings on the opposite side of the first critical point from the body, a bridge element, the bridge element further comprising individual bridge elements, an individual bridge element associated to each of the plurality of strings, the individual bridge element forming a second critical point for supporting each associated string, the individual bridge element adjustably secured to the body for intonating the associated string, each of the plurality of strings intonated collectively comprising harmonic tuning, a tailpiece element, the tailpiece element further securing the plurality of strings to the body, each associated string of the plurality of strings operable to be tensioned to pitch for play, strings tensioned for play comprises string force of tension, strings tensioned for play comprising harmonic tuning, the headpiece apparatus comprising:

a headpiece housing element, the headpiece housing element comprising a connected end and a free end, the connected end secured to the end of the neck, the free end extending away from the end of the neck, the headpiece housing element further comprising a nut side and a plain side, the nut side closest to the associated strings, the plain side opposite the nut side, headpiece housing element mounting screws, the headpiece housing element mounting screws to secure the headpiece housing element to the end of the neck, a secured headpiece housing element forming a first position, a headpiece housing recess, the headpiece housing recess formed between the free end and the connected end, the headpiece housing recess comprising a string passageway, the string passageway extending adjacent the first critical point in a direction away from the body to the free end, the string passageway comprising an individual string passageway for each associated string, the string passageway further comprising an associated recess, each associated recess within the headpiece housing element, an elongated clamp, an elongated clamp for each associated string, the elongated clamp extending in the direction of the string passageway, the elongated clamp variably positioned within each associated recess, the associated elongated clamp further comprising, either:

a clamp screw, the clamp screw threadedly connected to the headpiece housing element transverse the direction of the associated string, a clamp surface, the clamp surface adjustably connected to the clamp screw, wherein the clamp screw making variable contact with the elongated clamp to position the clamp surface to secure an associated string, threading the clamp screw positions the clamp surface to secure the associated string to the headpiece housing element and, thereby, to the instrument, or, a lever portion, the lever portion pivotally connected to the headpiece housing element, the lever portion comprising:

a string clamping portion, a string cutting portion, the string cutting portion on the opposite side of the first side from the tailpiece, the headpiece housing element further comprising:

a contact surface, the contact surface formed to variably receive the string clamping portion, the string clamping portion and contact surface operable to clamp the associated string, a cutting edge, the cutting edge to cooperate with the associated string cutting portion, string cutting portion and the cutting edge operable to cut the associated string, an open position, the string clamping portion and the string cutting portion are disengaged from the contact surface and the cutting edge, a closed position, the string clamping portion and the string cutting portion are engaged from the contact surface and the cutting edge, wherein an associated individual string passageway, adjusting the lever portion from a open position to a closed position, the string clamping portion clamps the associated string to the headpiece housing element contact surface and, thereby, to the instrument and cuts the associated string.

12. The apparatus of claim 11 wherein the headpiece housing element further comprises a removable nut, at least one mounting screw, wherein the at least one mounting screw threadedly securing the removable nut to the housing element to support the plurality of strings.

13. The apparatus of claim 11 wherein the headpiece housing element comprises setscrew passageways in the plain side, the setscrew passageways transverse the direction of the strings, the associated setscrews threadedly connected to the setscrews passageways, threading the associated setscrews to variably contact the end of the neck adjusts the plain end to vary first position.

14. The apparatus of claim 11 wherein the headpiece housing element comprises a pivot support element, the pivot support element transverse the direction of the strings, the lever portion further comprises a pivot slot and a lever setscrew, the lever portion pivot slot variably rotates on the pivot support element, the lever setscrew to threadedly contact the pivot support element within the pivot slot, adjusting the lever setscrew varies the closed position.

15. A headpiece tuner apparatus for a stringed musical instrument, the stringed musical instrument comprising a body, the body further comprising a top surface and a back surface, the top surface generally parallel to the back surface, a neck extending outwardly from the body, a plurality of strings extending in a direction from the body to the neck, the top surface and the back surfaces extending in the direction of the strings, the neck further comprising an end, a nut positioned at the end of the neck to form a first critical point for each of the strings, the end of the neck operable to variably secure each of the plurality of strings on the opposite side of the first critical point from the body, a bridge element, the bridge element further comprising individual bridge elements, an individual bridge element associated to each of the plurality of strings, the individual bridge element forming a second critical point for supporting each associated string, the individual bridge element adjustably secured to the body for intonating the associated string, each of the plurality of strings intonated collectively comprising harmonic tuning, a tailpiece element, the tailpiece element further securing the plurality of strings to the body, each associated string of the plurality of strings operable to be tensioned to pitch for play, strings tensioned for play comprises string force of tension, strings tensioned for play comprising harmonic tuning, the headpiece apparatus comprising:

a headpiece housing element, the headpiece housing element comprising a connected end and a free end, the connected end secured to the end of the neck, the free end extending away from the end of the neck, the headpiece housing element further comprising a nut side and a plain side, the nut side closest to the plurality of strings, the plain side opposite the nut side, the headpiece housing element comprising an opening, the opening aligned to the truss rod, the opening extending from the free end to the connected end in the direction of the rotating adjustment member, a thumbwheel extension element, the thumbwheel extension element having a first axis, the first axis aligned to the truss rod, the thumbwheel rotateably secured to the headpiece housing opening, the thumbwheel extension element further comprising a connecting portion further formed to cooperate with truss rod rotatable adjustment member, wherein adjusting the thumbwheel extension element is operable to turn the rotating adjustment member to adjust the position of the truss rod.

16. The apparatus of claim 15 wherein:

headpiece housing element mounting screws, the headpiece housing element mounting screws to secure the headpiece housing element to the end of the neck, a headpiece housing element secured to the neck forms a first position, a string passageway, the string passageway extending adjacent the first critical point in a direction away from the body, the string passageway comprising an individual string passageway for each associated string, the individual string passageway further comprising an associated recess, each associated recess within the housing element, an elongated clamp, the elongated clamp extending in the direction of the string passageway, the elongated clamp comprising:

an associated elongated clamp for each associated string, the associated elongated clamp variably positioned within each associated recess, the associated elongated clamp further comprising, either:

a setscrew, the setscrew comprising an associated individual setscrew for each associated recess, the associated individual setscrew threadedly connected to the headpiece housing element transverse the direction of the associated string, an associated first surface, the associated first surface formed to contact the string, an associated second surface, the associated second surface adjustably connected to an associated individual setscrew wherein the associated individual setscrew to make variable contact with the associated second surface to position the associated first surface, threading the associated setscrew positions the associated second surface to secure the associated string to the headpiece housing element and, thereby, to the instrument, or, a lever portion, the lever portion pivotally connected to the headpiece housing element, the lever portion having a closed position, the closed position closer the headpiece housing element and a open position, the open position further the headpiece housing element comprising:

an associated first surface, the associated first surface forming a formed string contact portion, an associated second surface, the associated second surface forming a string cutting portion, the cutting surface on the opposite side of the associated first side from the tailpiece, the headpiece housing element further comprising an associated contact surface, the associated contact surface to formed to receive the string contact portion, the headpiece housing element further comprising a cutting surface, the associated cutting edge to cooperate with the string cutting surface operable to cut a string, an open position, the associated cutting surface is disengaged from the associated cutting surface, a closed position, the associated cutting surface engaged with the associated cutting surface, wherein at least one of the plurality of strings in an associated string passageway, adjusting lever portion from a open position to a closed position, the formed string contact portion clamps the at least one of the plurality of strings to the headpiece housing element and, thereby, to the instrument and the string cutting portion cuts the at least one of the plurality of strings.

17. The apparatus of claim 15 wherein the headpiece housing element further comprises a removable nut, at least one mounting screw, wherein the at least one mounting screw threadedly securing the removable nut to the headpiece housing element to for the first critical point for the plurality of strings.

18. The apparatus of claim 15 wherein the headpiece housing element comprises setscrew passageways in the plain side, the setscrew passageways transverse the direction of the strings, the associated setscrews threadedly connected to the setscrews passageways, threading the associated setscrews contacts the end of the neck to variably adjust first position.

19. A headpiece apparatus for a stringed musical instrument, the stringed musical instrument comprising a body, the body further comprising a top surface and a back surface, the top surface generally parallel to the back surface, a neck extending outwardly from the body, a plurality of strings extending in a direction from the body to the neck, the top surface and the back surfaces extending in the direction of the strings, the neck further comprising an end, a nut positioned at the end of the neck to form a first critical point for each of the strings, the end of the neck operable to variably secure each of the plurality of strings on the opposite side of the first critical point from the body, a bridge element, the bridge element further comprising individual bridge elements, an individual bridge element associated to each of the plurality of strings, the individual bridge element forming a second critical point for supporting each associated string, the individual bridge element adjustably secured to the body for intonating the associated string, each of the plurality of strings intonated collectively comprising harmonic tuning, a ball-end for each of the plurality of strings to anchor the string to the stringed musical instrument a tailpiece element, the tailpiece element further securing the plurality of strings to the body, each associated string of the plurality of strings operable to be tensioned to pitch for play, strings tensioned for play comprises string force of tension, strings tensioned for play comprising harmonic tuning, a ball-end for each of the plurality of strings to anchor the string to the stringed musical instrument, the headpiece apparatus comprising:

a headpiece housing element, the headpiece housing element comprising a connected end and a free end, the connected end secured to the end of the neck, the free end extending away from the end of the neck, the headpiece housing element further comprising a nut side and a plain side, the nut side closest to the associated strings, the plain side opposite the nut side, headpiece housing element mounting screws, the headpiece housing element mounting screws to secure the headpiece housing element connected end to the end of the neck, the headpiece housing element secured to the neck forms a first position, a string passageway, the string passageway extending adjacent the nut in the connected end to the free end, the string passageway comprising an individual string passageway for each associated string, the individual string passageway further comprising an associated recess, each associated recess within the housing element, each associated recess formed to receive a ball-end of a string, wherein the headpiece housing element further comprising at least one opening, a single removable elongated element, the single removable elongated element operable to be inserted into the at least one opening, the single removable elongated element further comprising a handle.

20. The apparatus of claim 19 wherein the headpiece housing element comprises setscrew passageways in the plain side, the setscrew passageways transverse the direction of the strings, the associated setscrews threadedly connected to the setscrews passageways, threading the associated setscrews to variably contact the end of the neck adjusts the plain end to vary first position.

21. A stringed musical instrument, the stringed musical instrument comprising a body, the body further comprising a top surface and a back surface, the top surface generally parallel to the back surface, a neck extending outwardly from the body, a plurality of strings extending in a direction from the body to the neck, the top surface and the back surfaces extending in the direction of the strings, the neck further comprising an end, a nut positioned at the end of the neck to form a first critical point for each of the strings, the end of the neck operable to variably secure each of the plurality of strings on the opposite side of the first critical point from the body, a bridge element, the bridge element further comprising individual bridge elements, an individual bridge element associated to each of the plurality of strings, the individual bridge element forming a second critical point for supporting each associated string, the individual bridge element adjustably secured to the body for intonating the associated string, each of the plurality of strings intonated collectively comprising harmonic tuning, a tailpiece element, a ball-end for each of the plurality of strings to anchor the string to the stringed musical instrument, the tailpiece element further securing the plurality of strings to the body, each associated string of the plurality of strings operable to be tensioned to pitch for play, strings tensioned for play comprises string force of tension, strings tensioned for play comprising harmonic tuning, the stringed musical instrument comprising:

a tremolo, the tremolo pivotally mounted on the body for pivotally supporting the plurality of strings, the tremolo comprising a tremolo pivot axis, the tremolo operable to be pivoted rearward to increase tension and pitch of each of the plurality of strings, and forward to decrease tension and pitch of each of the plurality of strings, the fulcrum tremolo further comprising an apparatus, the apparatus secured to the fulcrum tremolo and moveable therewith around the pivot axis, the tremolo comprising:

a base plate comprising:

a first side furthest the body, a second side closer the body, at least one threaded element, the at least one threaded element connected to the tremolo, a magnetic biasing apparatus, the magnetic biasing apparatus comprising:

a first magnetic element, the first magnetic element formed to secure to the body, the first magnetic element comprising a first magnetic pole, a second magnetic element, the at least one threaded element to variably secure the second magnetic element to the tremolo, the second magnetic element comprising a second magnetic pole, the first magnetic pole aligned to the second magnetic pole, the first magnetic element and a second magnetic element in variable proximity, the first magnetic element and the second magnetic element in variable proximity exerting a variable elastic force, the variable elastic force comprising a first force of tension, the first force of tension to counter balance string force of tension, wherein strings tensioned for play, the first magnetic element, in variable proximity to the second magnetic element, obtains the first variable force of tension to bias string force of tension at initial position;AND a headpiece apparatus, the headpiece apparatus connected to the end of the neck, comprising:

a headpiece housing element, the headpiece housing element comprising a connected end and a free end, the connected end secured to the end of the neck, the free end extending away from the end of the neck, the element further comprising a nut side and a plain side, the nut side closest to the associated strings, the plain side opposite the nut side, headpiece housing element mounting screws, the headpiece housing element mounting screws to secure the headpiece housing element to the end of the headless nut, a secured housing element forms a first position, a headpiece housing recess, the headpiece housing recess formed between the free end and the connected end, the housing recess comprising a string passageway, the string passageway extending adjacent the nut in a direction away from the body to the free end, the string passageway comprising an individual string passageway for each associated string, the string passageway further comprising an associated recess, each associated recess within the headpiece housing element, each associated recess formed to receive a ball-end of a string, an elongated clamp, an elongated clamp for each associated string, the elongated clamp extending in the direction of the string passageway, the elongated clamp variably positioned within each associated recess, the associated elongated clamp further comprising, either:

a clamp screw, the clamp screw threadedly connected to the headpiece housing element transverse the direction of the associated string, a clamp surface, the clamp surface adjustably connected to the clamp screw, wherein the clamp screw making variable contact with the elongated clamp to position the clamp surface to secure an associated string, threading the clamp screw positions the clamp surface to secure the associated string to the headpiece housing element and, thereby, to the instrument, or, a lever portion, the lever portion pivotally connected to the headpiece housing element, the lever portion comprising:

a string clamping portion, a string cutting portion, the string cutting portion on the opposite side of the first side from the tailpiece, the headpiece housing element further comprising:

a contact surface, the contact surface formed to variably receive the string clamping portion, the string clamping portion and contact surface operable to clamp the associated string, a cutting edge, the cutting edge to cooperate with the associated string cutting portion, string cutting portion and the cutting edge operable to cut the associated string, an open position, the string clamping portion and the string cutting portion are disengaged from the contact surface and the cutting edge, a closed position, the string clamping portion and the string cutting portion are engaged from the contact surface and the cutting edge, wherein an associated individual string passageway, adjusting the lever portion from a open position to a closed position, the string clamping portion clamps the associated string to the headpiece housing element contact surface and, thereby, to the instrument and cuts the associated string, and the headpiece housing element further comprising an opening, the opening aligned to the truss rod, the opening extending from the free end to the connected end in the direction of the rotating adjustment member, the headpiece housing element further comprising at least one opening, a single removable elongated element, the single removable elongated element operable to be inserted into the at least one opening, the single removable elongated element further comprising a handle, a thumbwheel extension element, the thumbwheel extension element having a first axis, the first axis aligned to the truss rod, the thumbwheel rotateably secured to the headpiece housing opening, the thumbwheel extension element further formed to cooperate with truss rod rotatable adjustment member, wherein adjusting the thumbwheel extension element is operable to turn the rotating adjustment member to adjust the position of the truss rod.

* * * * *